US011808097B2

(12) United States Patent
Morrison et al.

(10) Patent No.: US 11,808,097 B2
(45) Date of Patent: Nov. 7, 2023

(54) FLOW RATE PRESSURE CONTROL DURING MILL-OUT OPERATIONS

(71) Applicant: Schlumberger Technology Corporation, Sugar Land, TX (US)

(72) Inventors: Richard Morrison, Sugar Land, TX (US); Sascha Trummer, Richmond, TX (US); Luis Silva, Richmond, TX (US); Zhanke Liu, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/878,762

(22) Filed: May 20, 2020

(65) Prior Publication Data

US 2020/0370379 A1 Nov. 26, 2020

Related U.S. Application Data

(60) Provisional application No. 62/924,744, filed on Oct. 23, 2019, provisional application No. 62/850,051,
(Continued)

(51) Int. Cl.
*E21B 3/02* (2006.01)
*E21B 10/44* (2006.01)
(Continued)

(52) U.S. Cl.
CPC ..... *E21B 19/22* (2013.01); *E21B 10/44* (2013.01); *E21B 17/20* (2013.01); *E21B 47/12* (2013.01); *E21B 3/02* (2013.01); *E21B 17/041* (2020.05)

(58) Field of Classification Search
CPC . E21B 3/02; E21B 10/44; E21B 17/20; E21B 19/22; E21B 29/00; E21B 47/12
See application file for complete search history.

(56) References Cited

U.S. PATENT DOCUMENTS 5,839,514 A 11/1998 Gipson
6,536,539 B2 3/2003 Merecka et al.
(Continued)

FOREIGN PATENT DOCUMENTS

EP 2773837 A2 9/2014
EP 2798150 A2 11/2014
(Continued)

OTHER PUBLICATIONS

International Search Report and Written Opinion issued in International Patent application PCT/US2020/033709 dated Sep. 1, 2020, 12 pages.
(Continued)

*Primary Examiner* — Matthew R Buck
(74) *Attorney, Agent, or Firm* — Rushi C. Sukhavasi

(57) ABSTRACT

Systems and methods presented herein facilitate operation of well-related tools. In certain embodiments, a variety of data (e.g., downhole data and/or surface data) may be collected to enable optimization of operations related to the well-related tools. In certain embodiments, the collected data may be provided as advisory data (e.g., presented to human operators of the well to inform control actions performed by the human operators) and/or used to facilitate automation of downhole processes and/or surface processes (e.g., which may be automatically performed by a computer implemented surface processing system (e.g., a well control system), without intervention from human operators). In certain embodiments, the systems and methods described herein may enhance downhole operations (e.g., milling operations) by improving the efficiency and utilization of data to enable performance optimization and improved resource controls of the downhole operations.

13 Claims, 13 Drawing Sheets

Related U.S. Application Data filed on May 20, 2019, provisional application No. 62/850,084, filed on May 20, 2019.

(51) Int. Cl.

| | |
|---|---|
| ***E21B 17/20*** | (2006.01) |
| ***E21B 19/22*** | (2006.01) |
| ***E21B 47/12*** | (2012.01) |
| *E21B 17/04* | (2006.01) |

(56) References Cited

U.S. PATENT DOCUMENTS

| | | | | |
|---|---|---|---|---|
| 6,923,273 | B2 | 8/2005 | Terry et al. | |
| 9,797,235 | B2 | 10/2017 | Ringer et al. | |
| 10,260,331 | B2 * | 4/2019 | Viens | E21B 45/00 |
| 10,753,163 | B2 * | 8/2020 | Dobkins | E21B 44/02 |
| 10,914,157 | B2 * | 2/2021 | Hassard | E21B 29/00 |
| 11,168,559 | B2 * | 11/2021 | Dobkins | E21B 19/08 |
| 2004/0069485 | A1 | 4/2004 | Ringgengberg et al. | |
| 2004/0238227 | A1 | 12/2004 | Smith et al. | |
| 2011/0153296 | A1 | 6/2011 | Sadlier et al. | |
| 2011/0174541 | A1 | 7/2011 | Strachan et al. | |
| 2011/0280104 | A1 | 11/2011 | McClung | |
| 2012/0217067 | A1 | 8/2012 | Mebane, III et al. | |
| 2013/0056223 | A1 | 3/2013 | Nichols | |
| 2015/0247396 | A1 | 9/2015 | Tunc et al. | |
| 2015/0356521 | A1 * | 12/2015 | Sridhar | G06Q 10/06316 705/305 |
| 2016/0115776 | A1 * | 4/2016 | Haci | E21B 43/261 175/27 |
| 2017/0122076 | A1 * | 5/2017 | Curry | E21B 44/00 |
| 2017/0145760 | A1 * | 5/2017 | Poyet | E21B 23/14 |
| 2017/0183930 | A1 * | 6/2017 | Livescu | E21B 33/134 |
| 2017/0321547 | A1 * | 11/2017 | Enkababian | G01N 15/088 |
| 2018/0266234 | A1 * | 9/2018 | Witte | E21B 19/22 |
| 2018/0334898 | A1 | 11/2018 | Zha et al. | |
| 2018/0334903 | A1 | 11/2018 | Lehr et al. | |
| 2019/0345779 | A1 | 11/2019 | Kennedy et al. | |
| 2020/0277841 | A1 * | 9/2020 | Olliff | E21B 41/0092 |
| 2021/0189864 | A1 | 6/2021 | Morrison et al. | |
| 2021/0238986 | A1 | 8/2021 | Newhouse | |

FOREIGN PATENT DOCUMENTS

| | | | |
|---|---|---|---|
| WO | 2008039411 | A2 | 4/2008 |
| WO | 2017062329 | A1 | 4/2017 |
| WO | 2017156111 | A1 | 9/2017 |
| WO | 2020236876 | A1 | 11/2020 |

OTHER PUBLICATIONS

International Preliminary Report on Patentability issued in International Patent application PCT/US2020/033709, dated Dec. 2, 2021, 11 pages.

Office Action issued in U.S. Appl. No. 17/123,363 dated Apr. 5, 2022, 14 pages.

National Oil Varco, "CTES Intervention Hardware and Software", 2016, Retrieved from the Internet on May 4, 2023: URL: https://www.nov.com/-/media/nov/files/brands/ctes/ctes-intervention-hardware-and-software-catalog.pdf?la=3n-us&hash=05C527B4981306ACB455B71276C8BC3E.

Hu, Y. et al., "Coiled tubing friction reduction of plug milling in long horizontal well with vibratory tool", Journal of Petroleum Science and Engineering, 2019, (177), pp. 452-465.

Extended Search Report issued in European Patent Application No. 20809144.7 dated May 15, 2023, 9 pages.

Office Action issued in U.S. Appl. No. 17/595,465 dated Jul. 6, 2023, 16 pages.

* cited by examiner

FLOW RATE PRESSURE CONTROL DURING MILL-OUT OPERATIONS

CROSS-REFERENCES TO RELATED APPLICATIONS

This application claims priority to and the benefit of U.S. Provisional Patent Application Ser. No. 62/850,051, entitled "Data Driven Well Tool System and Methodology," filed May 20, 2019, and claims priority to and the benefit of U.S. Provisional Patent Application Ser. No. 62/850,084, entitled "System and Methodology for Determining Appropriate Rate of Penetration in Downhole Applications," filed May 20, 2019, and claims priority to and the benefit of U.S. Provisional Patent Application Ser. No. 62/924,744, entitled "Flow Rate and Pressure Control During Mill-Out Operations," filed Oct. 23, 2019, each of which are hereby incorporated by reference in their entireties for all purposes.

BACKGROUND

The present disclosure generally relates to systems and methods for controlling operational parameters during mill-out operations and, more particularly, to the control of flow rate and pressure during coiled tubing mill-out operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

With respect to milling operations, coiled tubing may be used in plug milling following hydraulic fracturing operations. The coiled tubing may be used to deliver a bottom hole assembly and a corresponding milling tool downhole to enable milling of multiple plugs along, for example, lateral wellbores of 10,000 feet or more. However, current approaches to milling operations can be inefficient and rely on insufficient data for ensuring performance optimization and resource controls.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes deploying a downhole well tool into a wellbore of a well via coiled tubing. The method also includes detecting one or more surface parameters via one or more surface sensors associated with surface equipment located at a surface of the well. The method further includes processing, via a surface processing system, the one or more surface parameters during operation of the downhole well tool to enable automatic adjustment of one or more operational parameters of the surface equipment based at least in part on the one or more surface parameters.

In addition, certain embodiments of the present disclosure include a surface processing system that includes one or more non-transitory computer-readable storage media storing instructions which, when executed, cause at least one processor to perform operations. The operations include receiving one or more surface parameters detected by one or more surface sensors associated with surface equipment located at a surface of a well. The operations also include processing the one or more surface parameters during operation of a downhole well tool deployed in a wellbore of the well via coiled tubing to enable automatic adjustment of one or more operational parameters of the surface equipment based at least in part on the received one or more surface parameters.

In addition, certain embodiments of the present disclosure include a method that includes deploying a downhole well tool into a wellbore of a well via coiled tubing. The method also includes collecting downhole measurements via one or more downhole sensors associated with the downhole well tool. The method further includes processing, via a surface processing system, the downhole measurements during operation of the downhole well tool to identify a signal of interest from the collected downhole measurements, and to indicate a new formation zone based at least in part on the identified signal of interest.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
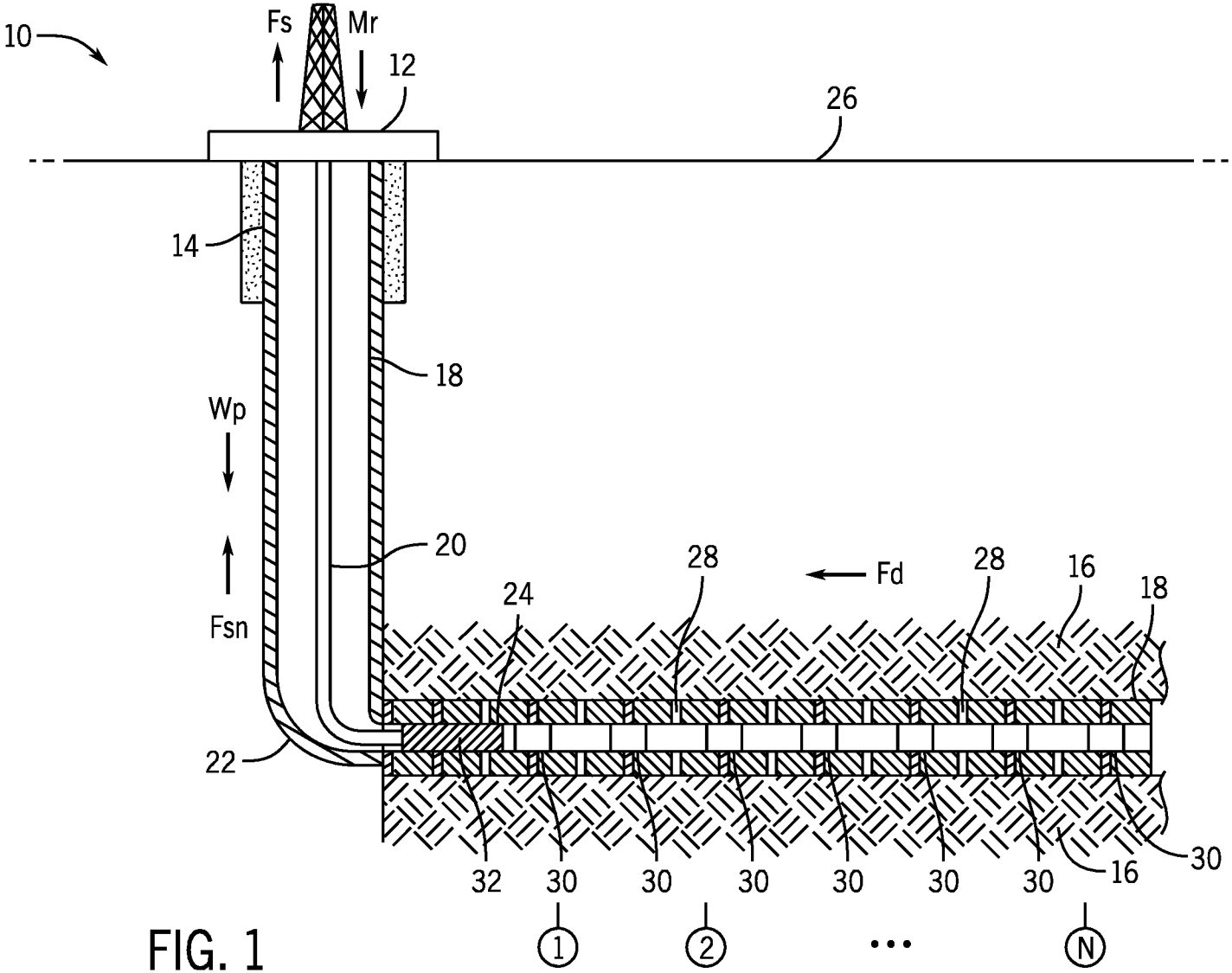
FIGS. 1 and 2 are schematic illustrations of an oilfield well that traverses a hydraulically-fractured hydrocarbon-bearing reservoir as well as a downhole well tool for milling out plugs that isolate a number of intervals offset from one another along the length of the well, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, a fracture shall be understood as one or more cracks or surfaces of breakage within rock. Fractures can enhance permeability of rocks greatly by connecting pores together and, for that reason, fractures can be induced mechanically in some reservoirs in order to boost hydrocarbon flow. Certain fractures may also be referred to as natural fractures to distinguish them from fractures induced as part of a reservoir stimulation. Fractures can also be grouped into fracture clusters (or "perf clusters") where the fractures of a given fracture cluster (perf cluster) connect to the wellbore through a single perforated zone. As used herein, the term "fracturing" refers to the process and methods of breaking down a geological formation and creating a fracture (i.e., the rock formation around a well bore) by pumping fluid at relatively high pressures (e.g., pressure above the determined closure pressure of the formation) in order to increase production rates from a hydrocarbon reservoir.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a processing system (i.e., solely by the processing system, without human intervention).

The embodiments described herein generally include systems and methods that facilitate operation of well-related tools. In certain embodiments, a variety of data (e.g., downhole data and/or surface data) may be collected to enable optimization of operations related to the well-related tools. In certain embodiments, the collected data may be provided as advisory data (e.g., presented to human operators of the well to inform control actions performed by the human operators) and/or used to facilitate automation of downhole processes and/or surface processes (e.g., which may be automatically performed by a computer implemented surface processing system (e.g., a well control system), without intervention from human operators). In certain embodiments, the systems and methods described herein may enhance downhole operations (e.g., milling operations) by improving the efficiency and utilization of data to enable performance optimization and improved resource controls of the downhole operations. In certain embodiments, a well tool may be deployed downhole into a wellbore via coiled tubing. In certain embodiments, the well tool may be in the form of a milling tool that may be used to mill out plugs or other downhole equipment. However, it will be appreciated that the systems and methods described herein also may be used for displaying or otherwise outputting desired (e.g., optimal) actions to human operators so as to enable improved decision-making regarding operation of the well tool (e.g., operation of a downhole or surface system/device).

In certain embodiments, downhole parameters are obtained via, for example, downhole sensors while the well tool is disposed in the wellbore. In certain embodiments, the downhole parameters may be obtained by the downhole sensors in substantially real time (e.g., as the downhole data is detected while the downhole well tool is being operated), and sent to the surface processing system (or other suitable processing system) via wired or wireless telemetry. The downhole parameters may be combined with surface parameters. In certain embodiments, the downhole and/or surface parameters may be processed during operation of the well tool downhole to enable automatic optimization (e.g., by the surface processing system, without human intervention) with respect to the operation of the well tool during subsequent stages of well tool operation. Examples of subsequent stages of well tool operation include milling of subsequent plugs disposed along a wellbore.

Furthermore, examples of downhole parameters that may be sensed in substantially real time (e.g., as the data is sensed while the downhole well tool is being operated) may include weight on bit (WOB), torque acting on the well tool, pressures, differential pressures, and other desired downhole parameters. In certain embodiments, the downhole parameters may be used in combination with surface parameters, and such surface parameters may include pump-related parameters (e.g., pump rate and circulating pressures). It should be noted that, in certain embodiments, pumps may be used to drive the downhole well tool. For example, a downhole milling tool may include a milling bit driven by a hydraulic motor.

In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from a coiled tubing unit (e.g., surface weight of the coiled tubing string, speed of the coiled tubing, rate of penetration, and other desired parameters). In certain embodiments, the surface data that is processed to optimize performance also may include previously recorded data such as fracturing data (e.g., close in pressures from each fracturing stage, proppant data, friction data, fluid volume data, and other desired data). In certain embodiments, desired combinations of downhole data and surface data may be combined to enhance, and to automate the downhole process, in certain embodiments.

Depending on the type of downhole operation, in certain embodiments, the downhole data and/or the surface data may be combined to prevent stalls and to facilitate stall recovery with respect to the downhole well tool. Appropriate processing of the downhole and/or the surface data by the surface processing system also facilitates cooperative operation of the coiled tubing unit, pumps, and flow back equipment described herein. This cooperation provides synergy that facilitates output of advisory information and/or automation of the downhole processes (e.g., milling processes) as well as appropriate adjustment of the rate of penetration (ROP) and pump rates for each individual stage of the operation. In a milling operation, for example, the individual stages may correspond with milling of each individual plug based on the surface data and/or the downhole data obtained in substantially real time. It should be noted that the data (e.g., the downhole data and/or the surface data) also may be used to provide advisory information and/or automation of surface processes such as pumping processes.

In some applications, use of this data enables the surface processing system to self-learn to provide, for example, optimum downhole WOB and torque for milling each subsequent plug in an efficient manner. This real-time modeling, based on the downhole and/or surface parameters, enables improved prediction of WOB, torque, and pressure differential for each plug after the plug most recently milled. Such modeling also enables the milling process (or other downhole process) to be automated and automatically optimized, in certain embodiments. In certain embodiments, the downhole parameters also may be used to predict motor or mill wear and to advise as to timing of the next trip to the surface for replacement of the motors and/or mills.

In certain embodiments, the downhole parameters also enable use of pressures below each milled plug to be used by the surface processing system to characterize the reservoir. Such real-time downhole parameters also enable use of pressures below each milled plug for in situ evaluation, advisory of post-fracturing flow back parameters, and for creating an optimum flow back schedule for maximized production of, for example, hydrocarbon fluids from the surrounding reservoir. In certain embodiments, the data available from a given well may be utilized in designing the next fracturing schedule for the same pad/neighbor wells as well as for plug milling predictions regarding subsequent wells.

Certain systems and methods have been used to characterize formation pressure in the past. For example, certain systems and methods for characterizing hydraulically-fractured hydrocarbon-bearing formations analyze flow characteristics of return fluid that flows from an interval back to a surface-located facility during well operations, and characterize at least one formation property of the fractured formation adjacent the interval. The embodiments described herein overcome disadvantages and shortcomings of existing systems and methods. For example, the embodiments described herein facilitate the control of downhole and surface pressures and flow rates during coiled tubing milling operations by, for example, orchestration of the pump and flowback controls, and further optimization via substantially real-time downhole and/or surface measurements. For example, in certain embodiments, pressure and flow rate measurements at both the pumps and flowback equipment, in addition to integrated choke control and pump controls, may be used by the surface processing system described herein (e.g., including programmable logic controllers (PLCs)).

Figure 2:
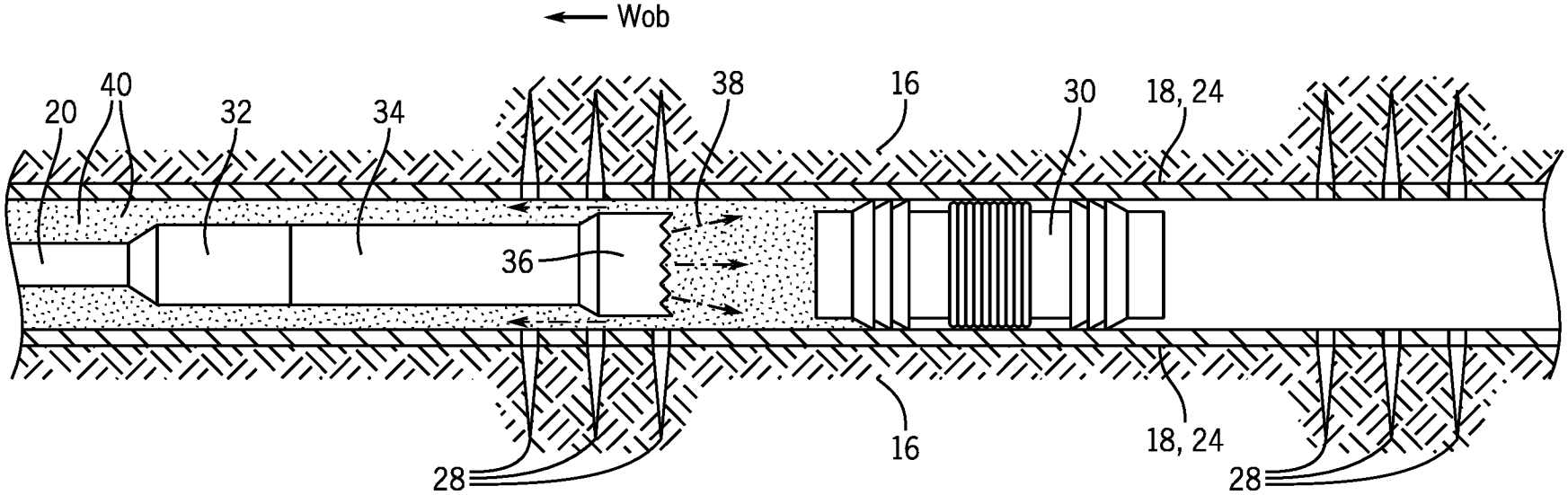
Figure 3:
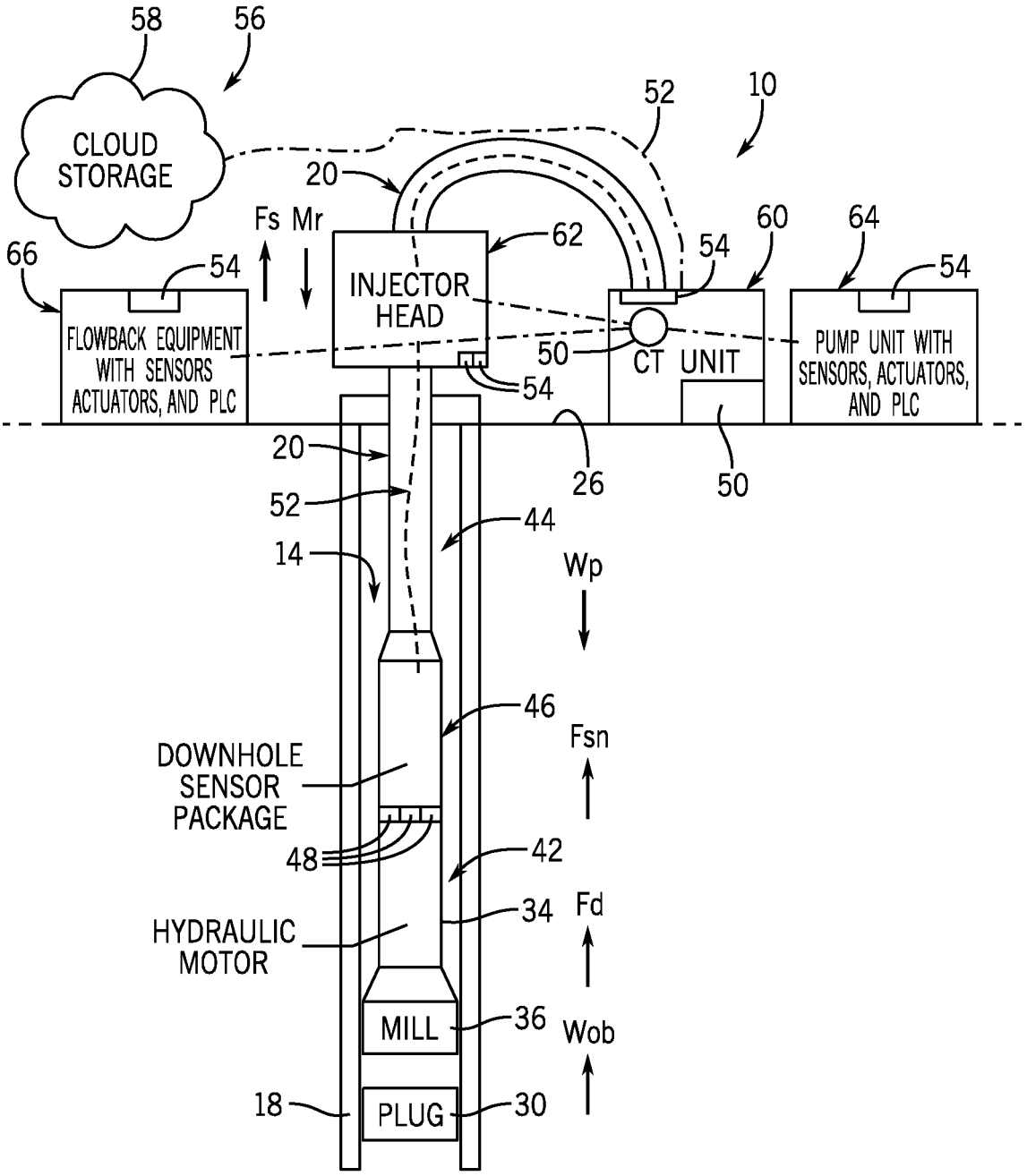
FIG. 3 is a schematic illustration of a well system that obtains sensor data to dynamically update information related to operation and control of a downhole well tool, in accordance with embodiments of the present disclosure.

With the foregoing in mind, FIGS. 1 and 2 are schematic illustrations of an example well system 10 that has undergone perforation and fracturing applications. As illustrated, in certain embodiments, a platform and derrick 12 may be positioned over a wellbore 14 that traverses a hydrocarbon-bearing reservoir 16 by rotary drilling. While certain elements of the well system 10 are illustrated in FIGS. 1 and 2, other elements of the well (e.g., blow-out preventers, wellhead "tree", etc.) have been omitted for clarity of illustration. In certain embodiments, the well system 10 includes an interconnection of pipes, including vertical and horizontal casing 18, tubing 20 (e.g., coiled tubing), transition 22, and a production liner 24 that connect to a surface facility (as illustrated in FIG. 3) at the surface 26 of the well system 10. In certain embodiments, the tubing 20 extends inside the casing 18 and terminates at a tubing head (not shown) at or near the surface 26. In addition, in certain embodiments, the casing 18 contacts the wellbore 14 and terminates at a casing head (not shown) at or near the surface 26. In certain embodiments, the production liner 24 and/or the horizontal casing 18 have aligned radial openings termed "perforation zones" 28 that allow fluid communication between the production liner 24 and the hydraulically fractured hydrocarbon-bearing reservoir or formation 16.

In certain embodiments, a number of plugs 30 may be disposed in the well system 10 at positions offset from one another along the longitudinal length of the wellbore 14 in order to provide hydraulic isolation between certain intervals of the well system 10 with a number of perforation zones 28 in each interval. In certain embodiments, each plug 30 may include one or more expanding slips and seal members for anchoring and sealing the plug 30 to the production liner 24 or the casing 18. In addition, in certain embodiments, each plug 30 may be formed primarily from composite materials (or other suitable materials) that enables the plug 30 to be milled-out for removal as described in greater detail herein.

In certain embodiments, a bottom hole assembly ("BHA") 32 may be run inside the casing 18 by the tubing 20 (which may be coiled tubing or drill pipe). As illustrated in FIG. 2, in certain embodiments, the BHA 32 may include a downhole motor 34 that operates to rotate a milling tool 36. In certain embodiments, the downhole motor 34 may be driven by hydraulic forces carried in milling fluid supplied from the surface 26 of the well system 10. In certain embodiments, the BHA 32 may be connected to the tubing 20, which is used to run the BHA 32 to a desired location within the wellbore 14. It is also contemplated that, in certain embodiments, the rotary motion of the milling tool 36 may be driven by rotation of the tubing 20 effectuated by a rotary table or other surface-located rotary actuator. In such embodiments, the downhole motor 34 may be omitted.

In certain embodiments, the tubing 20 may also be used to deliver milling fluid (arrows 38) to the milling tool 36 to aid in the milling process and carry cuttings and possibly other fluid and solid components in fluid 40 (referred to herein as "return fluid") that flows up the annulus between the tubing 20 and the casing 18 (or via a return flow path provided by the tubing 20, in certain embodiments) for return to the surface facility (as illustrated in FIG. 3). In certain embodiments, the BHA 32 may be located such that the milling tool 36 is positioned in direct contact with a plug 30. In such embodiments, the rotary motion of the milling tool 36 mills away the plug 30 into cuttings that flow as part of the return fluid 40 that is returned to the surface facility (as illustrated in FIG. 3). It is also contemplated that the return fluid 40 may include remnant proppant (e.g., sand) or possibly rock fragments that result from the hydraulic fracturing application, and flow within the well system 10 during the plug mill-out process. After the plug 30 is removed by the milling, a flow path is opened past the drill plug. Under certain conditions, fracturing fluid and possibly hydrocarbons (oil and/or gas), proppants and possibly rock fragments may flow from the fractured reservoir 16 through the perforations 28 in the newly opened interval and back to the surface 26 of the well system 10 as part of the return fluid 40. In certain embodiments, the BHA 32 may be supplemented behind the rotary drill by an isolation device such as, for example, an inflatable packer that may be activated to isolate the zone below or above it, and enable local pressure tests.

FIG. 3 is a schematic illustration of the well system 10 of FIGS. 1 and 2. As illustrated in FIG. 3, in certain embodiments, the well system 10 may include a downhole well tool 42 that is moved along the wellbore 14 via coiled tubing 20. In certain embodiments, the downhole well tool 42 may include a variety of drilling/cutting tools coupled with the coiled tubing 20 to provide a coiled tubing string 44. In the illustrated embodiment, the downhole well tool 42 includes a milling tool 36, which may be powered by a motor 34 (e.g., a positive displacement motor (PDM), or other hydraulic motor). In certain embodiments, the milling tool 36 may be used to mill out a plug 30 or plugs 30 disposed along the wellbore 14. Although described primarily herein as relating to embodiments for milling out plugs 30, in other embodiments, other type of milling targets may be milled out, such as cement, obstructions along the wellbore 14, naturally occurring obstructions such as deposits from formation fluid or injected fluid, objects left in the wellbore 14 from previous operations, warped or deformed completion tubulars, and so forth. In certain embodiments, the wellbore 14 may be an open wellbore or a cased wellbore defined by a casing 18. As described herein, in certain embodiments, the wellbore 14 may be vertical or horizontal or inclined. It should be noted the downhole well tool 42 may be part of various types of BHAs 32 coupled to the coiled tubing 20. In certain embodiments, the plug(s) 30 may be disposed along the wellbore 14 within a downhole completion.

Particularly, in certain embodiments, the plug(s) 30 may be disposed along a horizontal section of the wellbore 14. Once delivered in place, such plug(s) 30 may be anchored and sealed against the casing 18. Once anchored and sealed, perforation may be applied above the plug 30 through the casing 18, as illustrated in FIG. 2. The perforation application may be followed by hydraulic applications to direct high pressure fracturing fluid through the casing perforations 28 into the adjacent formation 16, to cause fracturing of reservoir rock for easier production. Typical hydraulic fracturing fluid may contain other substances such as proppant, sand, fiber, etc., to keep the fractures open after the completion of hydraulic fracturing. The placement, anchoring, perforation, and fracturing process may be repeated by moving from downhole to uphole interval by interval, until the entire formation and production zone are treated as designed.

Upon completion and treatment, such plugs 30 may be removed before producing the well. In general, removal of such plugs 30 requires milling out operations, usually by coiled tubing 20. To improve the efficacy of plug mill-outs, in certain embodiments, the well system 10 also may include a downhole sensor package 46 having a plurality of downhole sensors 48. In certain embodiments, the sensor package 46 may be mounted along the coiled tubing string 44, although certain downhole sensors 48 may be positioned at other downhole locations in other embodiments. In certain embodiments, data from the downhole sensors 48 may be relayed uphole to a surface processing system 50 (e.g., a computer-based processing system) disposed at the surface 26 and/or other suitable location of the well system 10.

In certain embodiments, the data may be relayed uphole in substantially real time (e.g., relayed while it is detected by the downhole sensors 48 during operation of the downhole well tool 42) via a wired or wireless telemetric control line 52, and this real-time data may be referred to as edge data. In certain embodiments, the telemetric control line 52 may be in the form of an electrical line, fiber-optic line, or other suitable control line for transmitting data signals. In certain embodiments, the telemetric control line 52 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 54 and/or stored in memory locations 56. By way of example, historical data and other useful data may be stored in a memory location 56 such as cloud storage 58.

As illustrated, in certain embodiments, the coiled tubing 20 may deployed by a coiled tubing unit 60 and delivered downhole via an injector head 62. In certain embodiments, the injector head 62 may be controlled to slack off or pick up on the coiled tubing 20 so as to control the tubing string weight and, thus, the weight on bit (WOB) acting on the bit of the milling tool 36 (or other downhole well tool 42).

In certain embodiments, fluid 38 may be delivered downhole under pressure from a pump unit 64. In certain embodiments, the fluid 38 may be delivered by the pump unit 64 through the downhole hydraulic motor 34 to power the downhole hydraulic motor 34 and, thus, the milling tool 36. In certain embodiments, the fluid 40 is returned uphole, and this flow back of fluid is controlled by suitable flow back equipment 66. In certain embodiments, the flow back equipment 66 may include chokes and other components/equipment used to control flow back of the return fluid 40 in a variety of applications, including well treatment applications.

In certain embodiments, the downhole well tool 42 may be moved along the wellbore 14 via the coiled tubing 20 under control of the injector head 62 so as to apply a desired tubing weight and, thus, to achieve a desired rate of penetration (ROP) as the milling tool 36 is operated to mill through the plugs 30. In certain embodiments, the controlled movement of the well tool 42 via the coiled tubing 20 may be used in a variety of applications other than milling out plugs 30. Depending on the specifics of a given application, various types of data may be collected downhole, and transmitted to the surface processing system 50 in substantially real time to facilitate improved operation of the downhole well tool 42. For example, the data may be used to fully or partially automate the downhole operation, to optimize the downhole operation, and/or to provide more accurate predictions regarding components or aspects of the downhole operation.

As described in greater detail herein, the pump unit 64 and the flowback equipment 66 may include advanced sensors, actuators, and local controllers, such as PLCs, which may cooperate together to provide sensor data to, receive control signals from, and generate local control signals based on communications with, respectively, the surface processing system 50. In certain embodiments, as described in greater detail herein, the sensors may include flow rate, pressure, and fluid rheology sensors, among other types of sensors. In addition, as described in greater detail herein, the actuators may include actuators for pump and choke control of the pump unit 64 and the flowback equipment 66, respectively, among other types of actuators.

Figure 4:
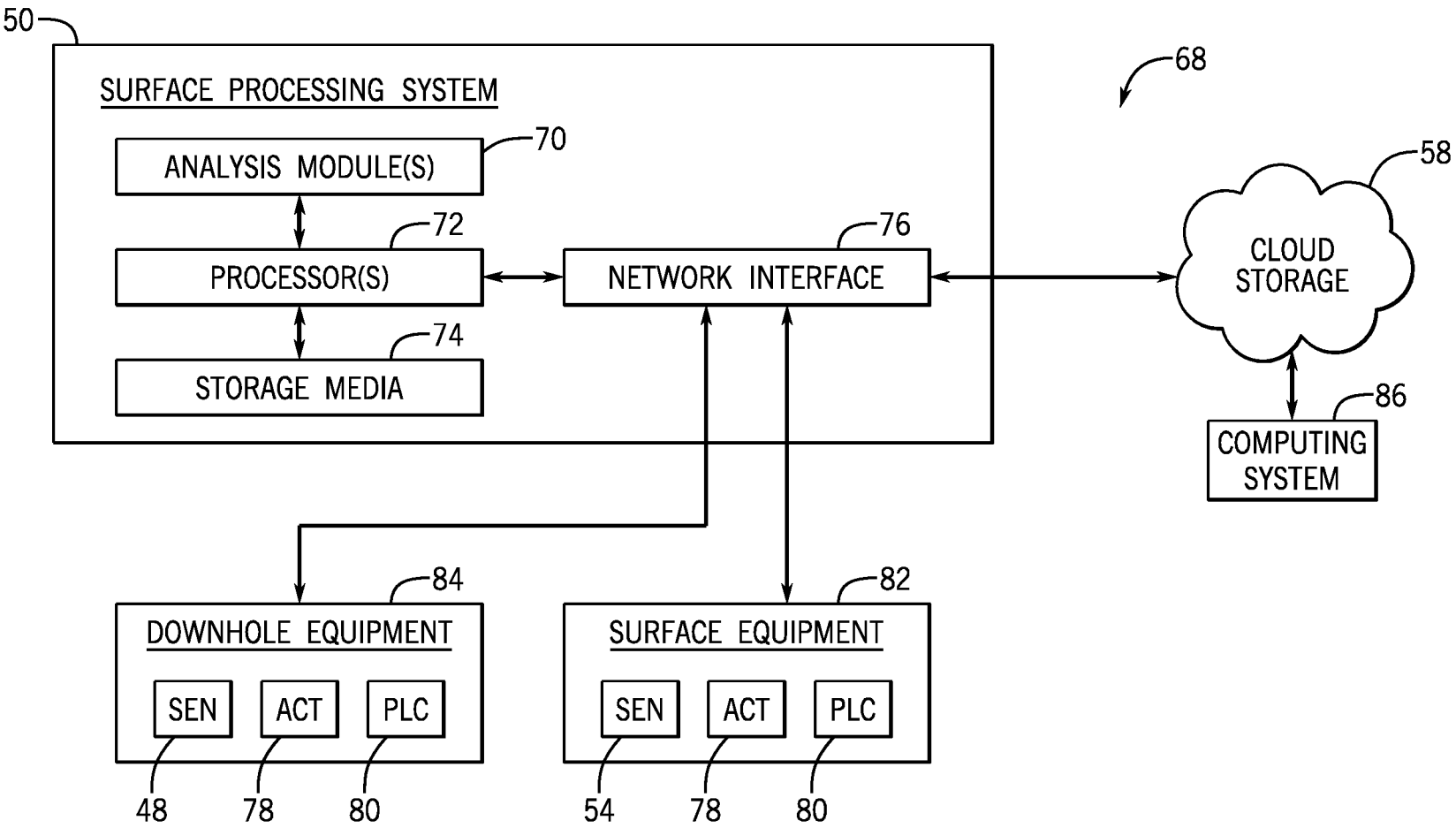
FIG. 4 illustrates a well control system that may include a surface processing system to control the well system described herein, in accordance with embodiments of the present disclosure.

FIG. 4 illustrates a well control system 68 that may include the surface processing system 50 to control the well system 10 described herein. In certain embodiments, the surface processing system 50 may include one or more analysis modules 70 (e.g., a program of computer-executable instructions and associated data) that may be configured to perform various functions of the embodiments described herein. In certain embodiments, to perform these various functions, an analysis module 70 executes on one or more processors 72 of the surface processing system 50, which may be connected to one or more storage media 74 of the surface processing system 50. Indeed, in certain embodiments, the one or more analysis modules 70 may be stored in the one or more storage media 74.

In certain embodiments, the one or more processors 72 may include a microprocessor, a microcontroller, a processor module or subsystem, a programmable integrated circuit, a programmable gate array, a digital signal processor (DSP), or another control or computing device. In certain embodiments, the one or more storage media 74 may be implemented as one or more non-transitory computer-readable or machine-readable storage media. In certain embodiments, the one or more storage media 74 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 70 may be provided on one computer-readable or machine-readable storage medium of the storage media 74, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 74 may be located either in the machine running the machine-readable instructions, or may be located at a remote site from which machine-readable instructions may be downloaded over a network for execution.

In certain embodiments, the processor(s) 72 may be connected to a network interface 76 of the surface processing system 50 to allow the surface processing system 50 to communicate with the various downhole sensors 48 and surface sensors 54 described herein, as well as communicate with the actuators 78 and/or PLCs 80 of the surface equipment 82 (e.g., the coiled tubing unit 60, the pump unit 64, the flowback equipment 66, and so forth) and of the downhole equipment 84 (e.g., the BHA 32, the downhole motor 34, the milling tool 36, the downhole well tool 42, and so forth) for the purpose of controlling operation of the well system 10, as described in greater detail herein. In certain embodiments, the network interface 76 may also facilitate the surface processing system 50 to communicate data to cloud storage 58 (or other wired and/or wireless communication network) to, for example, archive the data or to enable external computing systems 86 to access the data and/or to remotely interact with the surface processing system 50.

It should be appreciated that the well control system 68 illustrated in FIG. 4 is only one example of a well control system, and that the well control system 68 may have more or fewer components than shown, may combine additional components not depicted in the embodiment of FIG. 4, and/or the well control system 68 may have a different configuration or arrangement of the components depicted in FIG. 4. In addition, the various components illustrated in FIG. 4 may be implemented in hardware, software, or a combination of both hardware and software, including one or more signal processing and/or application specific integrated circuits. Furthermore, the operations of the well control system 68 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 42 illustrated in FIG. 3 by the surface processing system 50 illustrated in FIG. 4 (or other suitable processing system). In certain embodiments, the data may be provided as advisory data by the surface processing system 50 (or other suitable processing system). However, in other embodiments, the data may be used to facilitate automation of downhole processes and/or surface processes (i.e., the processes may be automated without human intervention), as described in greater detail herein, by the surface processing system 50 (or other suitable processing system). The embodiments described herein may enhance downhole operations (e.g., milling operations) by improving the efficiency and utilization of data to enable performance optimization and improved resource controls.

As described in greater detail herein, in certain embodiments, downhole parameters may be obtained via, for example, downhole sensors 48 while the downhole well tool 42 is disposed within the wellbore 14. In certain embodiments, the downhole parameters may be obtained in substantially real-time and sent to the surface processing system 50 via wired or wireless telemetry. In certain embodiments, downhole parameters may be combined with surface parameters by the surface processing system 50. In certain embodiments, the downhole and surface parameters may be processed by the surface processing system 50 during use of the downhole well tool 42 to enable automatic (e.g., without human intervention) optimization with respect to use of the downhole well tool 42 during subsequent stages of operation of the downhole well tool 42. Examples of subsequent stages of operation of the downhole well tool 42 include, but are not limited to, milling of subsequent plugs 30 disposed along a wellbore 14.

Examples of downhole parameters that may be sensed in real time include, but are not limited to, weight on bit (WOB), torque acting on the downhole well tool 42, downhole pressures, downhole differential pressures, and other desired downhole parameters. In certain embodiments, downhole parameters may be used by the surface processing system 50 in combination with surface parameters, and such surface parameters may include, but are not limited to, pump-related parameters (e.g., pump rate and circulating pressures of the pump unit 64). In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from the coiled tubing unit 60 (e.g., surface weight of the string of coiled tubing 20, speed of the coiled tubing 20, rate of penetration, and other desired parameters). In certain embodiments, the surface data that may be processed by the surface processing system 50 to optimize performance also may include previously recorded data such as fracturing data (e.g., close-in pressures from each fracturing stage, proppant data, friction data, fluid volume data, and other desired data).

In certain embodiments, depending on the type of downhole operation, the downhole data and surface data may be combined and processed by the surface processing system 50 to prevent stalls and to facilitate stall recovery with respect to the downhole well tool 42. In addition, in certain embodiments, processing of the downhole and surface data by the surface processing system 50 may also facilitate cooperative operation of the coiled tubing unit 60, the pump unit 64, the flowback equipment 66, and so forth. This cooperation provides synergy that facilitates output of advisory information and/or automation of the downhole process (e.g., milling process), as well as appropriate adjustment of the rate of penetration (ROP) and pump rates for each individual stage of the operation, by the surface processing system 50. In a milling operation, for example, the individual stages may correspond with milling of each individual plug 30 based on the surface data and downhole data obtained in real-time. It should be noted that the data (e.g., downhole data and surface data) also may be used by the surface processing system 50 to provide advisory information and/or automation of surface processes, such as pumping processes performed by the coiled tubing unit 60, the pump unit 64, the flowback equipment 66, and so forth.

In certain embodiments, use of this data enables the surface processing system 50 to self-learn to provide, for example, optimum downhole WOB and torque for milling each subsequent plug 30 in an efficient manner. This real-time modeling by the surface processing system 50, based on the downhole and surface parameters, enables improved prediction of WOB, torque, and pressure differentials for each plug 30 after the plug 30 that was most recently milled. Such modeling by the surface processing system 50 also enables the milling process (or other downhole process) to be automated and automatically optimized by the surface processing system 50. The downhole parameters also may be used by the surface processing system 50 to predict wear on the downhole motor 34 and/or milling tool 36, and to advise as to timing of the next trip to the surface for replacement of the downhole motor 34 and/or milling tool 36.

The downhole parameters also enable use of pressures below each milled plug 30 to be used by the surface processing system 50 in characterizing the reservoir 16. Such real-time downhole parameters also enable use of pressures below each milled plug 30 by the surface processing system 50 for in situ evaluation and advisory of post-fracturing flow back parameters, and for creating an optimum flow back schedule for maximized production of, for example, hydrocarbon fluids from the surrounding reservoir 16. The data available from a given well may be utilized in designing the next fracturing schedule for the same pad/neighbor wells as well as for plug milling predictions regarding subsequent wells.

During coiled tubing plug mill outs, for example, downhole data such as WOB, torque data from a load module associated with the downhole well tool 42, and bottom hole pressures (internal and external to the bottom hole assembly 32/downhole well tool 42) may be processed via the surface processing system 50. This processed data may then be employed by the surface processing system 50 to control the injector head 62 to generate, for example, a faster and more controlled ROP with respect to milling plugs 30 and/or other obstructions. Additionally, the data may be updated by the surface processing system 50 as the downhole well tool 42 is moved to different positions along the wellbore 14 to help optimize milling throughout stages of the operation. The data also enables automation of the milling process (or other process) through automated controls over the injector head 62 via control instructions provided by the surface processing system 50.

In certain embodiments, data from downhole may be combined by the surface processing system 50 with surface data received from injector head 62 and/or other measured or stored surface data. By way of example, surface data may include hanging weight of the string of coiled tubing 20, speed of the coiled tubing 20, wellhead pressure, choke and flow back pressures, return pump rates, circulating pressures (e.g., circulating pressures from the manifold of a coiled tubing reel in the coiled tubing unit 60), and pump rates. The surface data may be combined with the downhole data by the surface processing system 50 with in real time to provide an automated system that self-controls the injector head 62. For example, the injector head 62 may be automatically controlled (e.g., without human intervention) to optimize ROP as each plug 30 is milled automatically under direction from the surface processing system 50.

Accomplishing automated control over the milling process involves controlling the WOB by the ROP and predicting the WOB for subsequent plugs 30 to enable determination of an optimal ROP (and WOB) for application at each plug 30. In this example, real-time tubing force simulations may be run by the surface processing system 50 using data obtained during milling of the first plug 30. This data serves as a basis to help understand how the next plug milling will behave. The data also helps the surface processing system 50 predict the optimal WOB to maintain an optimum performance of downhole motor 34 by keeping parameters such as RPMs and force relatively stable. This also helps ensure the downhole motor 34 does not stall while optimizing (e.g., maximizing) the rapid milling of each plug 30.

In certain embodiments, data from drilling parameters (e.g., surveys and pressures) as well as fracturing parameters (e.g., volumes and pressures) may be combined with real-time data obtained from sensors 48, 54 during plug milling. The combined data may be used by the surface processing system 50 in a manner that aids in machine learning (e.g., artificial intelligence) to automate subsequent plug milling jobs in the same well and/or for neighboring wells. The accurate combination of data and the updating of that data in real time helps the surface processing system 50 improve the automatic milling of subsequent plugs 30 or performance of other subsequent tasks.

In certain embodiments, depending on the type of operation downhole, the surface processing system 50 may be programmed with a variety of algorithms and/or modeling techniques to achieve desired results. For example, the downhole data and surface data may be combined and at least some of the data may be updated in real time by the surface processing system 50. This updated data may be processed by the surface processing system 50 via suitable algorithms to enable automation and to improve the performance of, for example, downhole well tool 42. By way of example, the data may be processed and used by the surface processing system 50 for preventing motor stalls. In certain embodiments, downhole parameters such as forces, torque, and pressure differentials may be combined by the surface processing system 50 to enable prediction of a next stall of the downhole motor 34 and/or to give a warning to a supervisor. In such embodiments, the surface processing system 50 may be programmed to make self-adjustments (e.g., automatically, without human intervention) to, for example, speed of the injector head 62 and/or pump pressures to prevent the stall, and to ensure efficient continuous milling.

In addition, in certain embodiments, the data and the ongoing collection of data may be used by the surface processing system 50 to monitor various aspects of the performance of downhole motor 34. For example, motor wear may be detected by monitoring the effective torque of the downhole motor 34 based on data obtained regarding pump rates, pressure differentials, and actual torque measurements of the downhole well tool 42. Various algorithms may be used by the surface processing system 50 to help a supervisor on site to predict, for example, how many more hours the downhole motor 34 may be run or how many more plugs 30 may be milled efficiently. This data, and the appropriate processing of the data, may be used by the surface processing system 50 to make automatic decisions or to provide indications to a supervisor as to when to pull the string of coiled tubing 20 to the surface to replace the downhole motor 34, the milling tool 36, or both, while avoiding unnecessary trips to the surface.

In certain embodiments, downhole data and surface data also may be processed via the surface processing system 50 to predict when the string of coiled tubing 20 may become stuck. The ability to predict when the string of coiled tubing 20 may become stuck helps avoid unnecessary short trips and, thus, improves coiled tubing pipe longevity. In certain embodiments, downhole parameters such as forces, torque, and pressure differentials in combination with surface parameters such as weight of the coiled tubing 20, speed of the coiled tubing 20, pump rate, and circulating pressure may be processed via the surface processing system 50 to provide predictions as to when the coiled tubing 20 will become stuck.

In certain embodiments, the surface processing system 50 may be designed to provide warnings to a supervisor and/or to self-adjust (e.g., automatically, without human intervention) either the speed of the injector head 62, the pump pressures and rates of the pump unit 64, or a combination of both, so as to prevent the coiled tubing 20 from getting stuck. By way of example, the warnings or other information may be output to a display of the surface processing system 50 to enable an operator to make better, more informed decisions regarding downhole or surface processes related to operation of the downhole well tool 42. In certain embodiments, the speed of the injector head 62 may be controlled via the surface processing system 50 by controlling the slack-off force from the surface. In general, the ability to predict and prevent the coiled tubing 20 from becoming stuck substantially improves the overall milling efficiency, and helps avoid unnecessary short trips if the probability of the coiled tubing 20 getting stuck is minimal. Accordingly, the downhole data and surface data may be used by the surface processing system 50 to provide advisory information and/or automation of surface processes, such as pumping processes or other processes.

When milling each plug 30, trapped pressure is released, which alters the bottom hole pressure (BHP) at that moment. The pressure release may vary both the bottom hole pressure and the equivalent circulating density (ECD), thus altering the BHP dynamics. By monitoring the pressure changes downhole, along with other suitable parameters, the surface processing system 50 may be used to adjust (e.g., self-adjust) the choke/flow back returns via the flowback equipment 66. In general, the adjustments may be performed to maintain near balance conditions (i.e., to keep the downhole parameters within an acceptable range, such as within +/−5%) and to, thus, avoid fluid losses or gains downhole.

In certain embodiments, data from the fracturing stages previously executed in combination with real-time pressure data when each plug 30 is milled, provides a basis for real-time processing/simulations by the surface processing system 50. The real-time processing by the surface processing system 50 enables improved predictions regarding pressure control at the next stage. With accurate modeling/predictions, the flow back and choke control may be substantially improved. The real-time monitoring of downhole parameters such as pressure provides improved and timely feedback, which may be used by the surface processing system 50 to improve control over the downhole operation, and to facilitate automation of that control.

Figure 5:
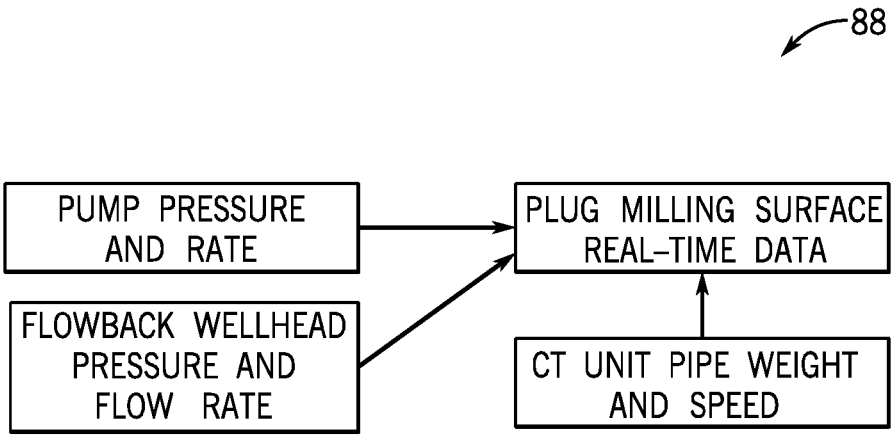
FIG. 5 is a schematic illustration showing various types of data that may be used to optimize performance of a downhole well tool during downhole operations, in accordance with embodiments of the present disclosure.

In certain embodiments, use of surface data and downhole data provided in real time may be used by the surface processing system 50 to facilitate and automate a variety of downhole processes (e.g., plug milling operations) or surface processes, as described in greater detail herein. For example, FIG. 5 illustrates a plug milling operation 88 in which surface data is collected and used by the surface processing system 50 in real time. As illustrated in FIG. 5, the surface processing system 50 may receive pump pressure and pump rate data (e.g., from sensors 54 associated with the pump unit 64) such as pressure and flow rate, flow back and wellhead pressure data (e.g., from sensors 54 associated with the flowback equipment 66 and the injector head 62, respectively), and weight and speed data relating to the coiled tubing (e.g., from sensors 54 associated with the coiled tubing unit 60) in substantially real time, and may use any and all combinations of this data to control a plug milling operation by, for example, sending control signals to control any and all of the operational parameters described herein.

Figure 6:
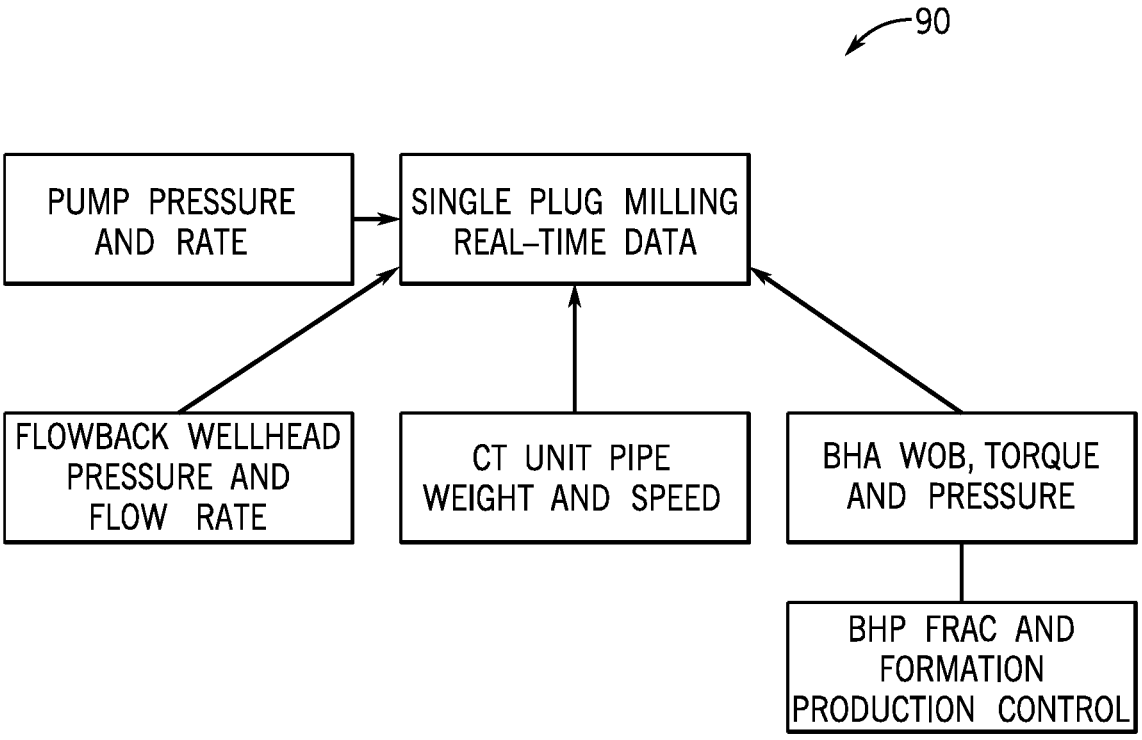
FIG. 6 is a schematic illustration showing various types of data that may be used to optimize performance of a downhole well tool during downhole operations, in accordance with embodiments of the present disclosure.

In certain embodiments, surface data may be combined with additional data obtained from a single plug milling (e.g., from an initial plug milling). For example, FIG. 6 illustrates a plug milling operation 90 in which surface data, along with additional data, is collected and used by the surface processing system 50 in real time. As illustrated in FIG. 6, examples of the additional data include, but are not limited to, downhole data relating to the bottom hole assembly 32, such as WOB, torque, and pressures. Other examples of the additional data include bottom hole pressure data, such as bottom hole pressure data related to fracturing and formation production control. Again, the surface processing system 50 may use any and all combinations of this data to control a plug milling operation by, for example, sending control signals to control any and all of the operational parameters described herein.

Figure 7:
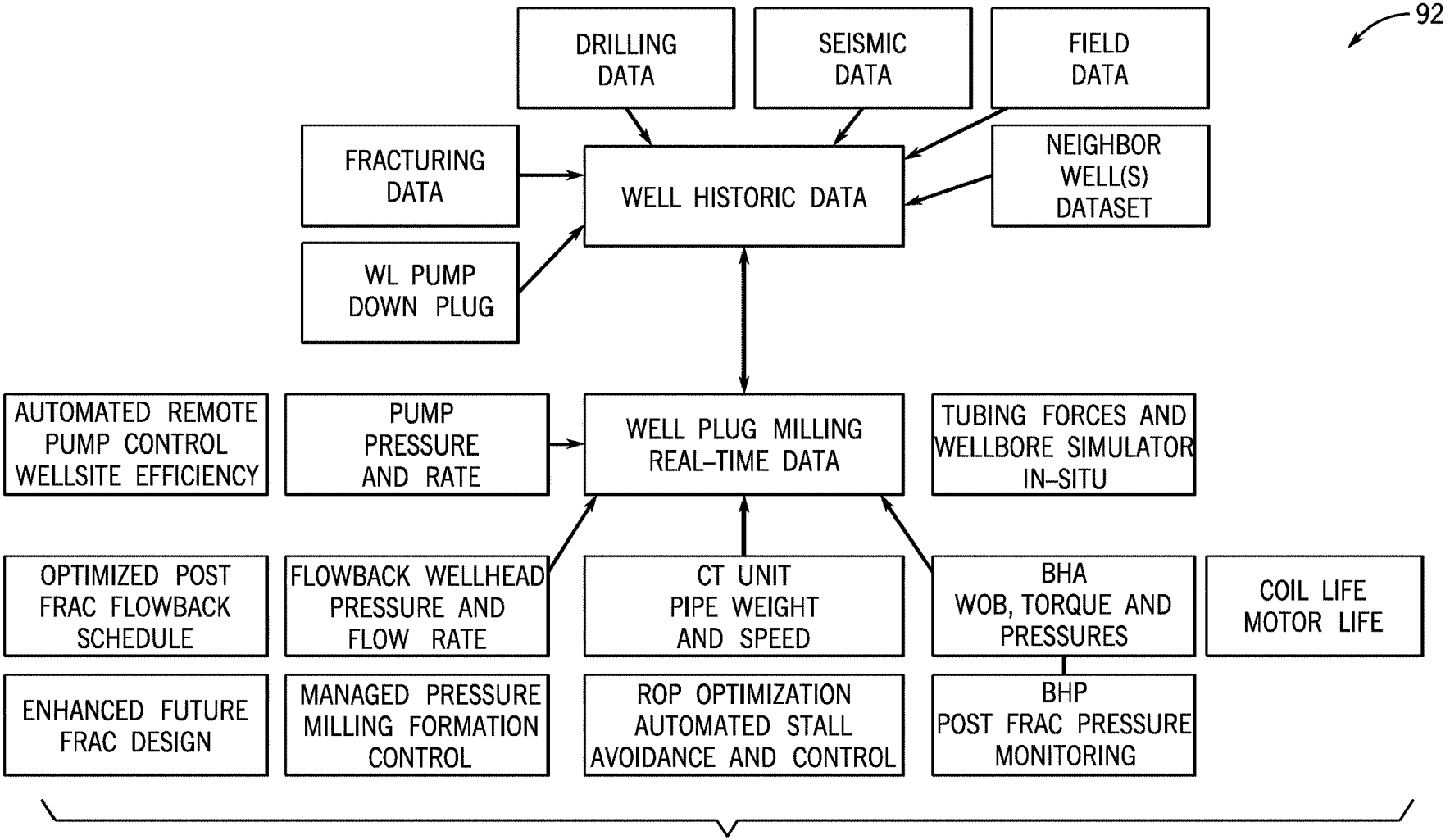
FIG. 7 is a schematic illustration showing various types of data that may be used to optimize performance of a downhole well tool during downhole operations, in accordance with embodiments of the present disclosure.

In addition, in certain embodiments, well historic data also may be used by the surface processing system 50 in, for example, making predictions and providing automated controls. For example, FIG. 7 illustrates a plug milling operation 92 in which surface data, along with additional data and historical data, is collected and used by the surface processing system 50 in real time. As illustrated in FIG. 7, examples of historical well data include historical pump down (e.g., wireline) plug data, historical fracturing data, historical drilling data, historical seismic data, historical field data, and historical data sets from neighboring wells. In certain embodiments, these various types of data may be combined and processed by the surface processing system 50 in via suitable algorithms or techniques to provide various, desired well controls such as automated remote pump control to promote wellsite efficiency.

As also illustrated in FIG. 7, other beneficial types of well control performed by the surface processing system 50 may include automated pump control and wellsite efficiency. In addition, in certain embodiments, the data also may be used by the surface processing system 50 to provide optimized post-fracturing flow back schedules and/or enhanced future fracturing design. In addition, in certain embodiments, the data also may be used by the surface processing system 50 to provide better managed formation control and pressure control to improve milling processes and other processes. For example, in certain embodiments, surface flow rate measurements may be used by the surface processing system 50 to control downhole pressures using the surface equipment described herein. In other words, the data may be used to actively control downhole pressures. In addition, in certain embodiments, the rate of penetration may be optimized by the surface processing system 50 to provide greater efficiency with respect to the overall operation while providing automated stall avoidance and control. In addition, in certain embodiments, various tubing force and wellbore simulations may be performed in situ and in real-time by the surface processing system 50. In addition, in certain embodiments, the data also may be used by the surface processing system 50 to provide life predictions with respect to, for example, predicted remaining life of the downhole motor 34 and/or predicted remaining life of the coiled tubing 20.

The use of real-time data from downhole milling processes (or other downhole or surface processes) and the automation of control by the surface processing system 50 enables a variety of well site improvements. For example, the embodiments described herein may be applied to enable remote operation of the pump unit 64, which allows removal of personnel otherwise present at the wellsite to operate the pump unit 64. In addition, the embodiments described herein provide instrumented flow back via the flowback equipment 66, which may be used, for example, to calculate Reynolds numbers. In addition, in certain embodiments, the wellsite data enables various additional analytics which may be provided to advisors by the surface processing system 50. In addition, in certain embodiments, the data may be used in a variety of ways by the surface processing system 50 including, but not limited to, stall avoidance of the downhole motor 34, reducing wear of the downhole motor 34, increasing life of the coiled tubing 20, avoiding stuck coiled tubing 20, and reducing short trips. The automation provided by the surface processing system 50 described herein also enables a reduction in the number of skilled operators at the wellsite. In addition, in milling applications, the real-time data enables better managed pressure milling, which can reduce formation damage, help characterize post-fracturing formation pressure for flow back, and increase component life by reducing circulation pressures.

FIGS. 8 through 11 illustrate various flow diagrams of processes for controlling the well system 10 described herein using the well control system 68 illustrated in FIG. 4. Specifically, in certain embodiments, the processes illustrated in FIGS. 8 through 11 may be implemented by the surface processing system 50 of the well control system 68 illustrated in FIG. 4 using downhole sensor data received from the downhole sensors 48 described herein, and using surface data received from the surface sensors 54 described herein. As illustrated in FIGS. 8 through 11, in certain embodiments, various operational parameters of the surface equipment 82 (e.g., the coiled tubing unit 60, the pump unit 64, the flowback equipment 66, and so forth) and the downhole equipment 84 (e.g., the BHA 32, the downhole motor 34, the milling tool 36, the downhole well tool 42, and so forth) of the well system 10 may be controlled by the well control system 68 illustrated in FIG. 4 (e.g., via interaction with the actuators 78 and/or the PLCs 80 of the surface equipment 82 and the downhole equipment 84) based at least in part on analysis performed by the one or more analysis modules 70 of the surface processing system 50 using the data received from the downhole sensors 48 and the surface sensors 54.

Figure 8:
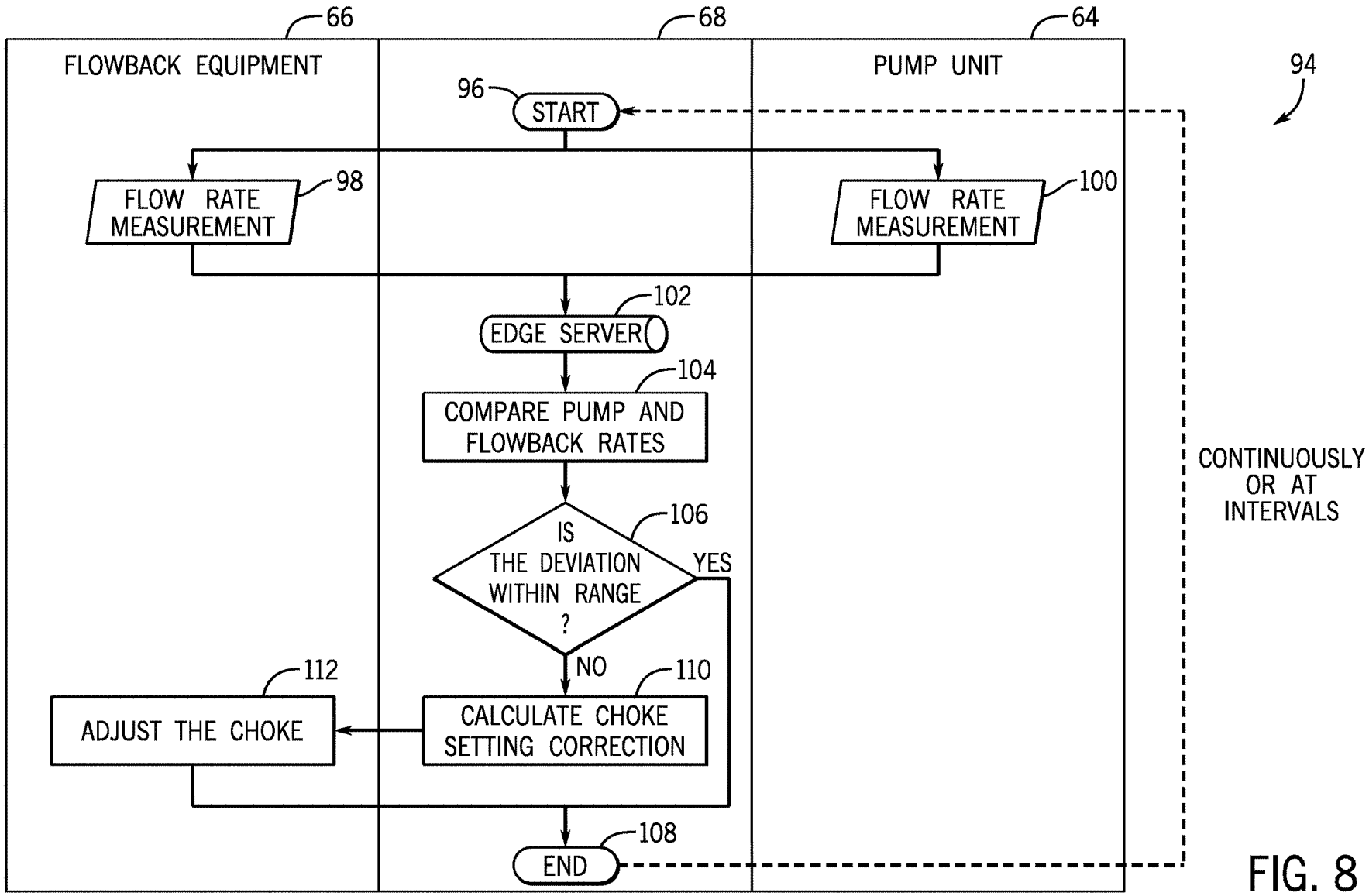
FIG. 8 is a flow diagram of a process for controlling fluid flow rates via choke adjustment, in accordance with embodiments of the present disclosure.

For example, FIG. 8 is a flow diagram of a process 94 for controlling fluid flow rates via choke adjustment. As illustrated in FIG. 8, the process 94 starts at block 96, then the flow rate of the return fluid 40 back through the flowback equipment 66 may be measured via a surface sensor 54 associated with the flowback equipment 66 (block 98), and the flow rate of the fluid 38 pumped into the wellbore 14 from the pump unit 64 may be measured via another surface sensor 54 associated with the pump unit 64 (block 100), in certain embodiments. In certain embodiments, data relating to the flow rate of the return fluid 40 and the flow rate of the fluid 38 pumped into the wellbore 14 may be stored, for example, in an edge server (block 102), which may form part of the well control system 68 illustrated in FIG. 4, or may be part of the cloud storage 58 illustrated in FIG. 4. Then, in certain embodiments, the flow rate of the return fluid 40 and the flow rate of the fluid 38 pumped into the wellbore 14 may be compared (block 104). In certain embodiments, the comparison may be performed by the edge server, or by the edge server in conjunction with the surface processing system 50.

In certain embodiments, a determination of whether the flow rate of the return fluid 40 and the flow rate of the fluid 38 pumped into the wellbore 14 are within a predetermined range (e.g., within 5% of each other, within 2% of each other, within 1% of each other, or even closer) may be made (block 106) based on the comparison of block 104. In certain embodiments, if the deviation between the flow rate of the return fluid 40 and the flow rate of the fluid 38 pumped into the wellbore 14 is within the predetermined range, the process 94 may end at block 108. Alternatively, if the deviation between the flow rate of the return fluid 40 and the flow rate of the fluid 38 pumped into the wellbore 14 is not within the predetermined range, a choke setting correction may be calculated (block 110) to restore a desired balance condition, and a choke setting of the flowback equipment 66 may be automatically adjusted based on the calculated choke setting correction (block 112) before the process 94 ends at block 108. In other embodiments, the calculated choke setting correction may simply be presented to an operator of the well system 10 (e.g., via a display of the surface processing system 50).

As illustrated in FIG. 8, in certain embodiments, the process 94 may be repeated continuously (e.g., the process 94 may start over at block 96 immediately following a previous iteration of the process 94 ends at block 108. Alternatively, as also illustrated in FIG. 8, in other embodiments, the process 94 may be periodically performed at predetermined time intervals. As such, in certain embodiments, the flow rate of the fluid 38 being pumped into the wellbore 14 by the pump unit 64 and the flow rate of the return fluid 40 that flows back up through the wellbore 14 into the flowback equipment 66 may be continuously or periodically optimized, for example, using the process 94 illustrated in FIG. 8.

Surface equipment data integration and automation, which may be attained via use of the process 94 illustrated in FIG. 8, may enable enhanced flow control of mill-out operations. However, surface adjustments made to the surface equipment 82, such as the flowback equipment 66, that react to downhole pressure variations that are experienced when breaking through to expose new perf clusters may be somewhat delayed until the effects are felt at the surface 26. Accordingly, the embodiments described herein also include methods for using downhole data to predict well dynamics behavior, and using this information to adjust pump and choke settings accordingly. As described herein, in certain embodiments, these adjustments may be done using advisors or in an automated fashion.

Another additional benefit of downhole pressure measurements is the ability to assess the quality of the perf cluster that is currently being exposed by the mill-out operations. The mill-out operations provide the first (and likely the last) access to the perf clusters post-fracture, and significant interplay between perf clusters may have changed their behavior since the time of fracturing. As such, the embodiments described herein also include methods for formation characterization using downhole pressure measurements.

Figure 9:
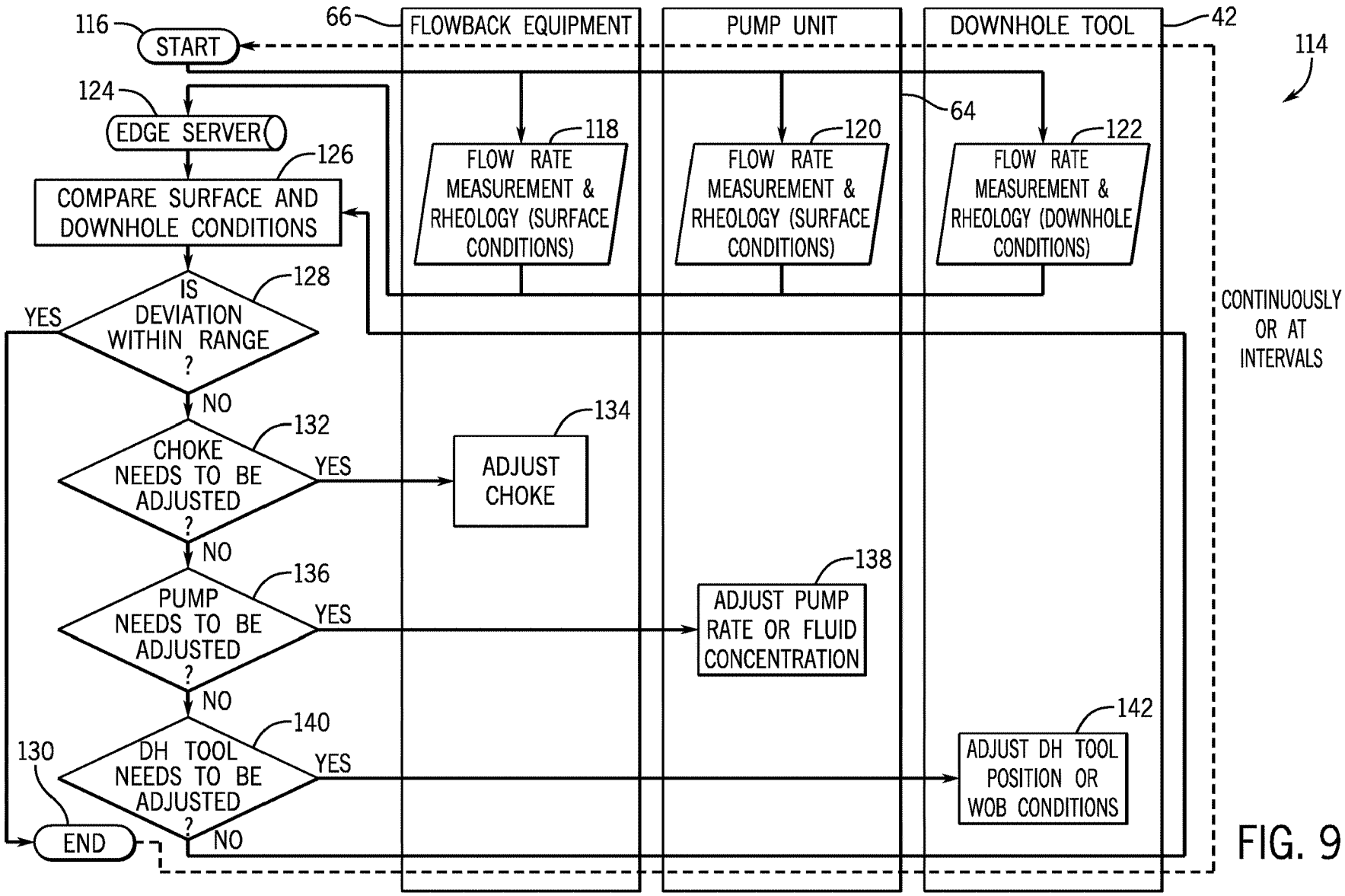
FIG. 9 is a flow diagram of a process for controlling fluid flow rates and rheology via choke, pump, and downhole well tool adjustments, in accordance with embodiments of the present disclosure.

FIG. 9 is a flow diagram of a process 114 for controlling fluid flow rates and rheology via choke, pump, and downhole well tool adjustments. As illustrated in FIG. 9, the process 114 starts at block 116, then the flow rate and the rheology of the return fluid 40 back through the flowback equipment 66 may be measured via one or more surface sensors 54 associated with the flowback equipment 66 (block 118), the flow rate and the rheology of the fluid 38 pumped into the wellbore 14 from the pump unit 64 may be measured via one or more surface sensors 54 associated with the pump unit 64 (block 120), and the flow rate and the rheology of the fluid 38 flowing through the downhole well tool 42 may be measured via one or more downhole sensors 48 associated with the downhole well tool 42 (block 122), in certain embodiments. In certain embodiments, data relating to the flow rate and rheology of the return fluid 40 and the flow rate and rheology of the fluid 38 pumped into the wellbore 14 and flowing through the downhole well tool 42 may be stored, for example, in an edge server (block 124), which may form part of the well control system 68 illustrated in FIG. 4, or may be part of the cloud storage 58 illustrated in FIG. 4. Then, in certain embodiments, the flow rate and the rheology of the return fluid 40 and the flow rate and the rheology of the fluid 38 pumped into the wellbore 14 at the surface 26 may be compared to the flow rate and the rheology of the fluid 38 flowing through the downhole well tool 42 (block 126). In certain embodiments, the comparison may be performed by the edge server, or by the edge server in conjunction with the surface processing system 50.

In certain embodiments, a determination of whether the flow rate and/or the rheology of the return fluid 40 and the flow rate and/or the rheology of the fluid 38 pumped into the wellbore 14 are within predetermined ranges (e.g., within 5% of each other, within 2% of each other, within 1% of each other, or even closer) with respect to the flow rate and/or the rheology of the fluid 38 flowing through the downhole well tool 42 may be made (block 128) based on the comparisons of block 126. In certain embodiments, if the deviations between the flow rate and/or the rheology of the return fluid 40 and the flow rate and/or the rheology of the fluid 38 pumped into the wellbore 14 are within the predetermined ranges with respect to the flow rate and/or the rheology of the fluid 38 flowing through the downhole well tool 42, the process 114 may end at block 130.

Alternatively, if the deviations between the flow rate and/or the rheology of the return fluid 40 and the flow rate and/or the rheology of the fluid 38 pumped into the wellbore 14 are not within the predetermined ranges with respect to the flow rate and/or the rheology of the fluid 38 flowing through the downhole well tool 42, certain adjustments may be made in order to restore a desired balance condition. For example, in certain embodiments, a choke setting correction may be calculated (block 132), and a choke setting of the flowback equipment 66 may be automatically adjusted based on the calculated choke setting correction (block 134) before the process 114 is directed back to block 126. In addition, in certain embodiments, a pump rate and/or fluid concentration setting correction may be calculated (block 136), and a pump rate and/or fluid concentration setting (e.g., an amount and/or type of fluid additives) of the pump unit 64 may be automatically adjusted based on the calculated pump rate and/or fluid concentration setting correction (block 138) before the process 114 is directed back to block 126. In addition, in certain embodiments, a position, torque, and/or WOB setting correction may be calculated (block 140), and a position, torque, and/or WOB setting of the downhole well tool 42 may be automatically adjusted based on the calculated position, torque, and/or WOB setting correction (block 142) before the process 114 is directed back to block 126. In certain embodiments, each of these corrections may be made in the presented order until no further corrections are needed (e.g., when the deviations between the flow rate and/or the rheology of the return fluid 40 and the flow rate and/or the rheology of the fluid 38 pumped into the wellbore 14 are within the predetermined ranges with respect to the flow rate and/or the rheology of the fluid 38 flowing through the downhole well tool 42). As discussed herein, in other embodiments, the calculated setting corrections may simply be presented to an operator of the well system 10 (e.g., via a display of the surface processing system 50).

As illustrated in FIG. 9, in certain embodiments, the process 114 may be repeated continuously (e.g., the process 114 may start over at block 116 immediately following a previous iteration of the process 114 ends at block 130. Alternatively, as also illustrated in FIG. 9, in other embodiments, the process 114 may be periodically performed at predetermined time intervals. By properly adjusting one or multiple of these settings and conditions, the deviated flowback, pumping, downhole tool, and milling operations may be brought back to an optimal state by the surface processing system 50.

Figure 10:
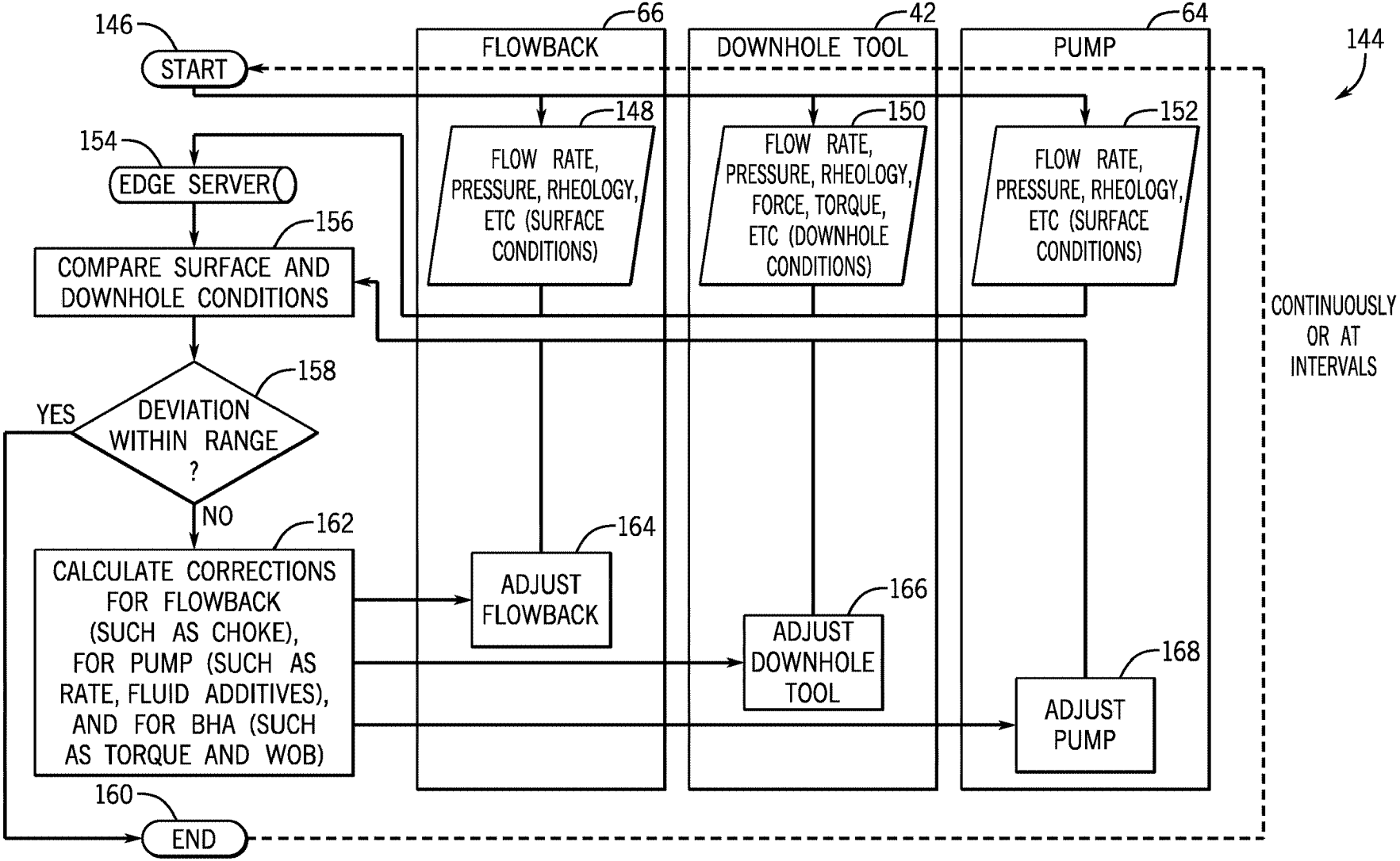
FIG. 10 is a flow diagram of a process for controlling fluid flow rates, pressure, and rheology via choke, pump, and downhole well tool adjustments, in accordance with embodiments of the present disclosure.

FIG. 10 is a flow diagram of a process 144 for controlling fluid flow rates, pressure, and rheology via choke, pump, and downhole well tool adjustments. As illustrated in FIG. 10, the process 144 starts at block 146, then the flow rate, the pressure, and the rheology of the return fluid 40 back through the flowback equipment 66 may be measured via one or more surface sensors 54 associated with the flowback equipment 66 (block 148), the flow rate, the pressure, and the rheology of the fluid 38 flowing through the downhole well tool 42, as well as the forces and torque applied to the downhole well tool 42 (e.g., by the downhole hydraulic motor 34) may be measured via one or more downhole sensors 48 associated with the downhole well tool 42 (block 150), and the flow rate, the pressure, and the rheology of the fluid 38 pumped into the wellbore 14 from the pump unit 64 may be measured via one or more surface sensors 54 associated with the pump unit 64 (block 152), in certain embodiments. In certain embodiments, data relating to the flow rate, pressure, and rheology of the return fluid 40 and the flow rate, pressure, and rheology of the fluid 38 pumped into the wellbore 14 and flowing through the downhole well tool 42 (as well as data relating to the forces and torque applied to the downhole well tool 42) may be stored, for example, in an edge server (block 154), which may form part of the well control system 68 illustrated in FIG. 4, or may be part of the cloud storage 58 illustrated in FIG. 4. Then, in certain embodiments, the flow rate, the pressure, and the rheology of the return fluid 40 and the flow rate, the pressure, and the rheology of the fluid 38 pumped into the wellbore 14 at the surface 26 may be compared to the flow rate, the pressure, and the rheology of the fluid 38 flowing through the downhole well tool 42 (block 156). In certain embodiments, the comparison may be performed by the edge server, or by the edge server in conjunction with the surface processing system 50.

In certain embodiments, a determination of whether the flow rate, the pressure, and/or the rheology of the return fluid 40 and the flow rate, the pressure, and/or the rheology of the fluid 38 pumped into the wellbore 14 are within predetermined ranges (e.g., within 5% of each other, within 2% of each other, within 1% of each other, or even closer) with respect to the flow rate, the pressure, and/or the rheology of the fluid 38 flowing through the downhole well tool 42 may be made (block 158) based on the comparisons of block 156. In certain embodiments, if the deviations between the flow rate, the pressure, and/or the rheology of the return fluid 40 and the flow rate, the pressure, and/or the rheology of the fluid 38 pumped into the wellbore 14 are within the predetermined ranges with respect to the flow rate, the pressure, and/or the rheology of the fluid 38 flowing through the downhole well tool 42, the process 144 may end at block 160.

Alternatively, if the deviations between the flow rate, the pressure, and/or the rheology of the return fluid 40 and the flow rate, the pressure, and/or the rheology of the fluid 38 pumped into the wellbore 14 are not within the predetermined ranges with respect to the flow rate and/or the rheology of the fluid 38 flowing through the downhole well tool 42, certain adjustments may be made in order to restore a desired balance condition. For example, in certain embodiments, a choke setting correction may be calculated (block 162), and a choke setting of the flowback equipment 66 may be automatically adjusted based on the calculated choke setting correction (block 164) before the process 144 is directed back to block 156. In addition, in certain embodiments, a position, torque, and/or WOB setting correction may be calculated (block 162), and a position, torque, and/or WOB setting of the downhole well tool 42 may be automatically adjusted based on the calculated position, torque, and/or WOB setting correction (block 166) before the process 144 is directed back to block 156. In addition, in certain embodiments, a pump rate and/or fluid concentration setting correction may be calculated (block 162), and a pump rate and/or fluid concentration setting (e.g., an amount and/or type of fluid additives) of the pump unit 64 may be automatically adjusted based on the calculated pump rate and/or fluid concentration setting correction (block 168) before the process 144 is directed back to block 156. In certain embodiments, each of these corrections may be based at least in part on the data relating to the forces and torque applied to the downhole well tool 42. In addition, in certain embodiments, each (or, at least some) of these corrections may be made in the presented order, or in a different order, or simultaneously, until no further corrections are needed (e.g., when the deviations between the flow rate, the pressure, and/or the rheology of the return fluid 40 and the flow rate, the pressure, and/or the rheology of the fluid 38 pumped into the wellbore 14 are within the predetermined ranges with respect to the flow rate and/or the rheology of the fluid 38 flowing through the downhole well tool 42). As discussed herein, in other embodiments, the calculated setting corrections may simply be presented to an operator of the well system 10 (e.g., via a display of the surface processing system 50).

As illustrated in FIG. 10, in certain embodiments, the process 144 may be repeated continuously (e.g., the process 144 may start over at block 146 immediately following a previous iteration of the process 144 ends at block 160. Alternatively, as also illustrated in FIG. 10, in other embodiments, the process 144 may be periodically performed at predetermined time intervals. By properly adjusting one or multiple of these settings and conditions, the deviated flowback, pumping, downhole tool, and milling operations may be brought back to an optimal state by the surface processing system 50.

In other embodiments, the downhole measurements described herein may be collected, and used to identify and analyze signals p of interest from the downhole measurements to, for example, indicate certain types of new formation zones that are encountered as the downhole well tool 42 traverses downhole through the wellbore 14. When the surface processing system 50 identifies signals p of interest that indicate certain types of new formation zones that are encountered by the downhole well tool 42, the surface processing system 50 may automatically adjust certain operational parameters of the well system 10 (e.g., flow rates and pressures of the fluids 38, 40 described herein) to account for the new formation zones. Such methods enable pressure and flow management that operates in a more informed manner, rather than in an ad-hoc fashion.

Figure 11:
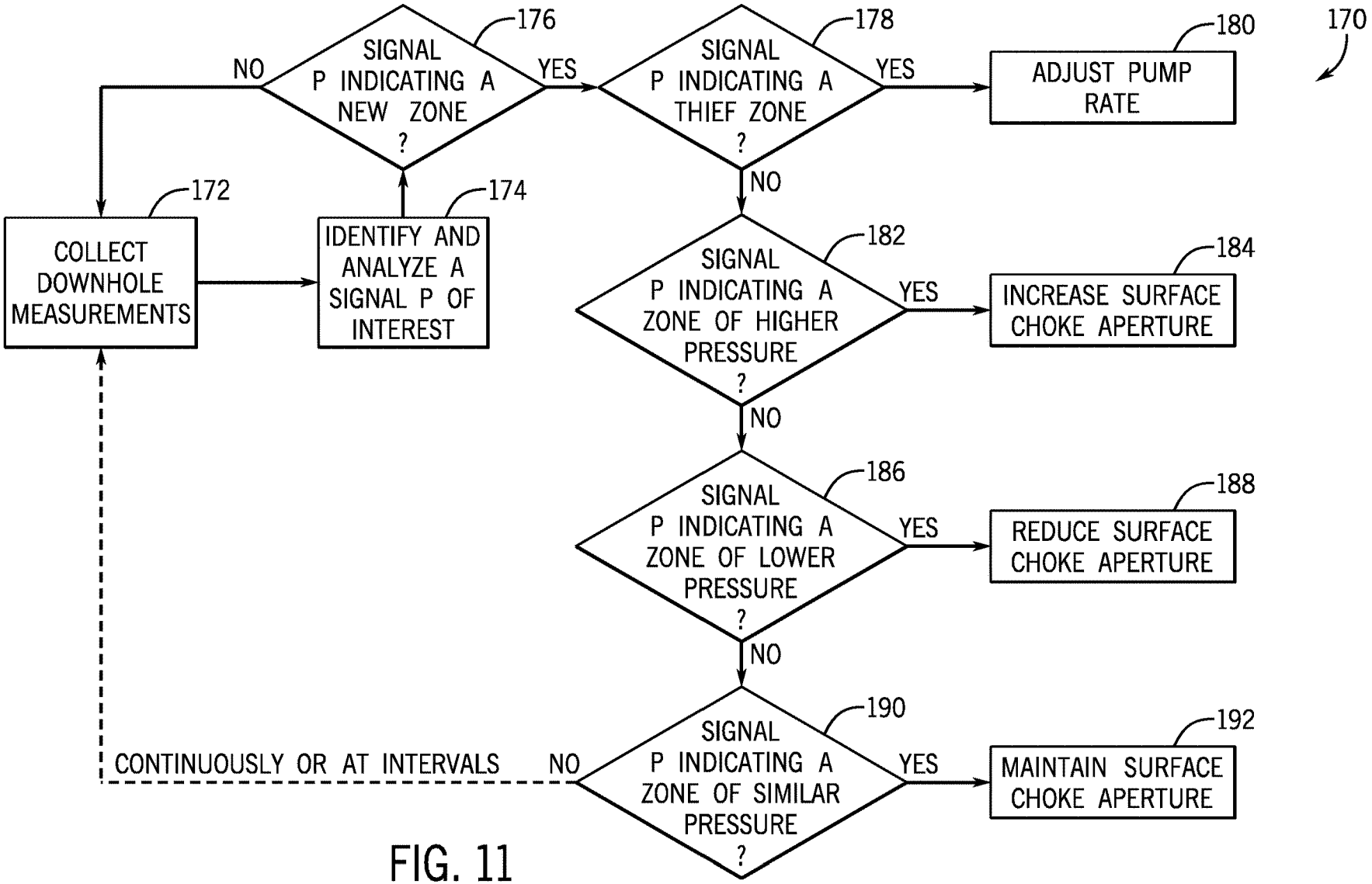
FIG. 11 is a flow diagram of a process for controlling fluid flow rates and pressures based on identification and analysis of signals p of interest in downhole measurements, in accordance with embodiments of the present disclosure.

For example, FIG. 11 is a flow diagram of a process 170 for controlling fluid flow rates and pressures based on identification and analysis of signals p of interest in downhole measurements collected from downhole sensors 48 as described herein. The process begins with the collection of downhole measurements via the downhole sensors 48 described herein (block 172). In certain embodiments, the downhole measurements may include the measurement of any and all of the downhole parameters described herein including, but not limited to, the flow rate, the pressure, and the rheology of the fluid 38 flowing through the downhole well tool 42, as well as the forces and torque applied to the downhole well tool 42 (e.g., by the downhole hydraulic motor 34). Then, signals p of interest may be identified and analyzed (block 174), and determinations may be made about whether the signals p of interest indicate that a new formation zone is being encountered by the downhole well tool 42 as the downhole well tool is traversing downhole through the wellbore 14. If a signal p of interest indicates that a new formation zone is not currently being encountered by the downhole well tool 42 (block 176), the process 170 may proceed back to block 172.

However, if a signal p of interest indicates that a new formation zone is being encountered by the downhole well tool 42 (block 176), the process 170 may determine if automatic adjustments to certain operational parameters of the well system 10 should be made. For example, if a signal p of interest indicates that a new formation zone is a thief zone (block 178), then a pump rate of the pump unit 64 may be automatically adjusted in response to this determination (block 180) to minimize fluid losses while maintain circulation rates to ensure efficient cleaning. However, it should be noted that, in certain embodiments, if a signal p of interest indicates that a new formation zone is a thief zone (block 178), another course of action may be to automatically reduce a choke aperture of a choke of the flowback equipment 66. In addition, if a signal p of interest indicates that a new formation zone has a higher pressure than a previously-encountered formation zone (block 182), then a choke aperture of a choke of the flowback equipment 66 may be automatically increased in response to this determination (block 184). Conversely, if a signal p of interest indicates that a new formation zone has a lower pressure than a previously-encountered formation zone (block 186), then a choke aperture of a choke of the flowback equipment 66 may be automatically reduced in response to this determination (block 188). Furthermore, if a signal p of interest indicates that a new formation zone has a substantially similar pressure (e.g., within 5% of each other, within 2% of each other, within 1% of each other, or even closer) to that of a previously-encountered formation zone (block 190), then a choke aperture of a choke of the flowback equipment 66 may be maintained (i.e., not adjusted) in response to this determination (block 192).

As illustrated in FIG. 11, in certain embodiments, the process 170 may be repeated continuously (e.g., the process 170 may start over at block 172 immediately following a previous iteration of the process 170 ends. Alternatively, as also illustrated in FIG. 11, in other embodiments, the process 170 may be periodically performed at predetermined time intervals. By properly adjusting one or multiple of these settings and conditions, the new formation zones that are encountered by the downhole well tool 42 may be automatically accounted for by the surface processing system 50.

Each of the processes 94, 114, 144, 170 may be performed by the surface processing system 50 individually, or may be performed by the surface processing system 50 in conjunction with each other. For example, in certain embodiments, any and all of the surface parameters and/or the downhole parameters described herein may be used as inputs by the surface processing system 50 to determine appropriate output control signals to control any and all of the operational parameters described herein. In other words, the individual processes 94, 114, 144, 170 described herein are merely exemplary, and not intended to be limiting. In general, each of these processes 94, 114, 144, 170 facilitates faster and more accurate responses to changes that occur downhole while the downhole well tool 42 traverses the wellbore 14 during, for example, mill-out operations of plugs 30.

The embodiments described herein may be used to optimize (e.g., maximize) a rate of penetration for milling out plugs 30 disposed along a wellbore 14 using the well control system 68 illustrated in FIG. 4. For example, in certain embodiments, the well control system 68 may be used to maximize a rate of penetration for milling out plugs 30 along a wellbore 14 after hydraulic fracturing operations.

As explained in greater detail herein, in certain embodiments, a downhole well tool 42 (e.g., a milling tool) may be coupled with coiled tubing 20 to form a coiled tubing string. In addition, in certain embodiments, downhole sensors 48 may be positioned along the string of coiled tubing 20 to obtain sensor data when the downhole well tool 42 is moved along the wellbore 14. In certain embodiments, the sensor data from the downhole sensors 48 may then be used by the surface processing system 50 to determine a coefficient of friction (COF) value based on friction acting on the string of coiled tubing 20. In certain embodiments, as the downhole well tool 42 is moved to different positions along the wellbore 14, the COF value may be updated by the surface processing system 50 (e.g., based on the changing sensor data from the downhole sensors 48) to obtain updated COF values. In certain embodiments, the updated COF values may then be employed by the surface processing system 50 to adjust a tubing weight acting on the downhole well tool 42 to achieve a desired rate of penetration (ROP). In certain embodiments, the sensor data from the downhole sensors 48 may be provided to the surface processing system 50 in real-time to enable real-time updating of the COF value. Additionally, in certain embodiments, the sensor data obtained by the downhole sensors 48 during actual operation may be combined with surface data (e.g., monitored data and/or historical data) and/or other types of data to facilitate accurate modeling of the optimal (e.g., maximum) ROP.

In certain embodiments, the efficiency of a given operation (e.g., a milling operation) may be optimized by the surface processing system 50 by determining a desired ROP. For example, in certain embodiments, the weight of the coiled tubing 20 may be adjusted to achieve the desired ROP (e.g., to maintain the desired ROP within a predetermined threshold, such as +/−10% of the desired ROP, +/−5% of the desired ROP, +/−3% of the desired ROP, +/−1% of the desired ROP, or even closer) based at least in part on a coefficient of friction (COF), which is based on friction acting on the string of coiled tubing 20 (e.g., friction between the coiled tubing 20 and a surrounding wall of the wellbore 14), as described in greater detail herein. In general, more accurate knowledge with respect to the COF enables a more efficient ROP and, thus, a more efficient overall operation.

In an operational example, the ROP may be maximized. In certain embodiments, this maximization of the ROP may be achieved by the surface processing system 50 by leveraging edge data and cloud data computations, by integrating downhole and surface measurement data with historical well and treatment data, and by calculating tubing string force in real-time through parametric calibration without compromising downhole equipment and surface equipment integrity. Such data may be processed via the surface processing system 50 to improve the accuracy and consistency of tubing force prediction for achieving desired results.

For example, optimal WOB predictions and implementations may be used by the surface processing system 50 in achieving the maximum ROP possible, for example, based on other operational parameters. In certain embodiments, the well control system 68 may control WOB instead of ROP in order to maximize ROP. In other words, a more accurate and consistent tubing force prediction generally leads to a more accurate and consistent WOB prediction and application during a given operation. Due to reduced uncertainty in tubing force and WOB prediction, a faster ROP may be achieved with higher confidence and lower risk. In certain embodiments, various types of software modules may be used by the surface processing system 50 to predict the weight of the coiled tubing at the surface as a function of depth of the coiled tubing 20. Such software modules may be referred to as tubing force modules (TFM).

In general, monitoring and controlling WOB in substantially real time may lead to enhanced optimization of ROP. For example, the ability to quickly and accurately detect significant changes in WOB may lead to enhanced optimization of ROP. In certain embodiments, WOB may be obtained via direct downhole measurements, for example, via downhole sensors 48. For example, for direct downhole load cell measurements, the change in WOB may be calculated (e.g., by the surface processing system 50) as:

$$\Delta W_{ob}=W_{ob2}-W_{ob1} \tag{1}$$

where ΔWob is the change in WOB, $Wob_2$ is the measured WOB at time moment $t_2$, and $Wob_1$ is the measured WOB at time moment $t_1$.

However, as described in greater detail herein, WOB may be obtained via indirect surface measurements, for example, via surface sensors 54. For example, for indirect surface load cell measurements, the determination of a change in WOB is relatively more complex. As illustrated in FIGS. 1-3, for a typical run in hole (RIH) operation, the force balance yields the following:

$$M_r=(W_p-F_{sn})-(F_d+F_s)-W_{ob} \tag{2}$$

where $M_r$ is the surface load measurement (e.g., via a load cell or load pin in certain embodiments), $W_p$ is the weight of the buoyed pipe (i.e., coiled tubing 20) and the BHA 32, $F_{sn}$ is the snubbing force, $F_d$ is the pipe-on-wall drag force due to friction, $F_s$ is the stripper-induced friction, and $W_{ob}$ is the downhole WOB. Of these elements, $F_{sn}$ (the snubbing force) and $F_s$ (the stripper friction) are usually relatively constant (e.g., vary less than 1% or even less) within a relatively short distance of BHA travel. Thus, the change in WOB, within a relatively short distance of BHA travel, may be calculated as in Equation (3):

$$\Delta W_{ob}=W_{ob2}-W_{ob1}=(W_{p2}-F_{d2}-M_{rs})-(W_{p1}-F_{d1}-M_{r1}) \tag{3}$$

where in Equation (3), the subscript 2 indicates time moment $t_2$, and the subscript 1 indicates time moment $t_1$. Equation (3) shows that the change in WOB may be calculated by the surface processing system 50 based on the surface load measurements, in conjunction with the weight of the buoyed pipe (i.e., coiled tubing 20) and the BHA 32 and the pipe-on-wall drag force due to friction calculations. As such, as described in greater detail herein, the COF, which is based on friction acting on the string of coiled tubing 20 (e.g., friction between the coiled tubing 20 and a surrounding wall of the wellbore 14), is a relatively important value to be determined by the surface processing system 50 in order to indirectly determine WOB based on surface measurements collected by surface sensors 54, for example.

It may be assumed that correlations exist between surface and downhole measurements with respect to WOB. In general, the surface measurements usually tend to lag behind the downhole measurements and tend to have a lower amplitude. With this in mind, in certain embodiments, the surface processing system 50 may calibrate the indirect surface WOB measurements (e.g., Equation (3)) with the direct downhole WOB measurements (e.g., Equation (1)) to enhance the ability of WOB control by the surface processing system 50. This enables more accurate and consistent WOB control, for example, when downhole measurements are not available.

In certain embodiments, an empirically determined COF between the string of coiled tubing 20 and the surrounding well surface (e.g., of the wellbore 14) may be used by the surface processing system 50 to predict the weight of the coiled tubing 20 at the surface to achieve a desired ROP. For example, in certain embodiments, the determined COF between the string of coiled tubing and the surrounding wellbore 14 may be used by the surface processing system 50 to determine the pipe-on-wall drag force due to friction ($F_d$) described herein. However, the COF changes as the downhole well tool 42 is moved to different depths in the wellbore 14. As described in greater detail herein, in certain embodiments, the data obtained from the downhole sensor package 46 and the downhole sensors 48 may be combined with surface data from surface sensors 54 and/or historical data by the surface processing system 50 to continually update the COF value at different depths or stages of a given well operation.

In certain embodiments, the surface processing system 50 may dynamically calibrate the COF in real time during a given job to provide continually updated COF values. Referring to FIG. 1, the downhole well tool 42 may be moved down through a long horizontal section of wellbore 14 to sequentially mill out a plurality of plugs 30. In this example, the COF value may be updated by the surface processing system 50 at several positions along the entire wellbore 14 as the downhole well tool 42 is run in hole. In such an embodiment, the COF may be updated by the surface processing system 50 at N different positions along the wellbore 14 as the downhole well tool 42 and the coiled tubing 20 are running in hole. In certain embodiments, the COF may be updated by the surface processing system 50 to periodically (e.g., updated at a given time interval). In certain embodiments, the distance along the wellbore 14 between the N different positions may be adjusted by the surface processing system 50 as desired to achieve a successful operation. For example, the distance between positions at which the COF is updated by the surface processing system 50 may be at most 500 feet, at most 50 feet, at most 5 feet, or at other suitable distances depending on well conditions and operational parameters.

Similarly, in certain embodiments, the COF value may be updated by the surface processing system 50 at N different depths or positions along the wellbore 14 during operations in which the downhole well tool 42 is pulled out of hole. Once again, the distance between positions at which the COF may be updated by the surface processing system 50 may be at most 500 feet, at most 50 feet, at most 5 feet, or at other suitable distances depending on well conditions and operational parameters of the pulling out of hole operation. It should be noted that, in certain embodiments, the distances between COF updates may vary, whereas the COF value may be updated substantially continuously (e.g., in substantially real time) in other embodiments.

Figure 12:
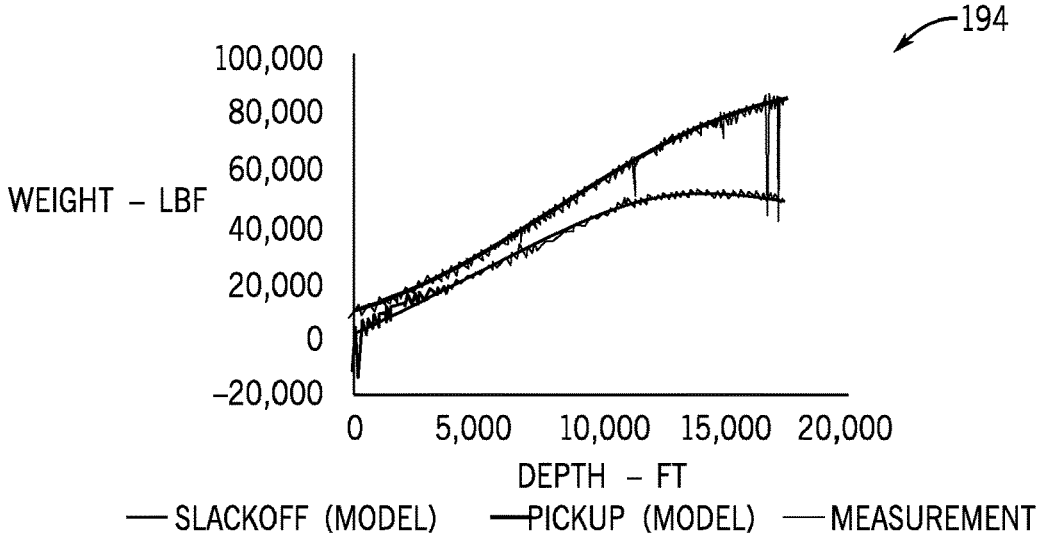
FIG. 12 is a graphical representation illustrating model versus measured coiled tubing weight, in accordance with embodiments of the present disclosure.

By utilizing the appropriate downhole data and surface data (e.g., edge data and storage/cloud data), the changing COF value resulting from changes in well conditions and operational conditions may be determined by the surface processing system 50 so as to improve the WOB/tubing string weight determination. This, in turn, enables improved accuracy and maximization of the ROP, thereby resulting in a more efficient overall milling operation or other downhole operation. As illustrated in the graph 194 in FIG. 12, use of downhole data and surface data enables a strong correlation between the modeled weight of the coiled tubing 20 and the measured weight of the coiled tubing 20 for achieving a maximized ROP. As such, monitoring and use of this data substantially improves the accuracy and consistency of weight prediction for achieving the desired ROP.

Figure 13:
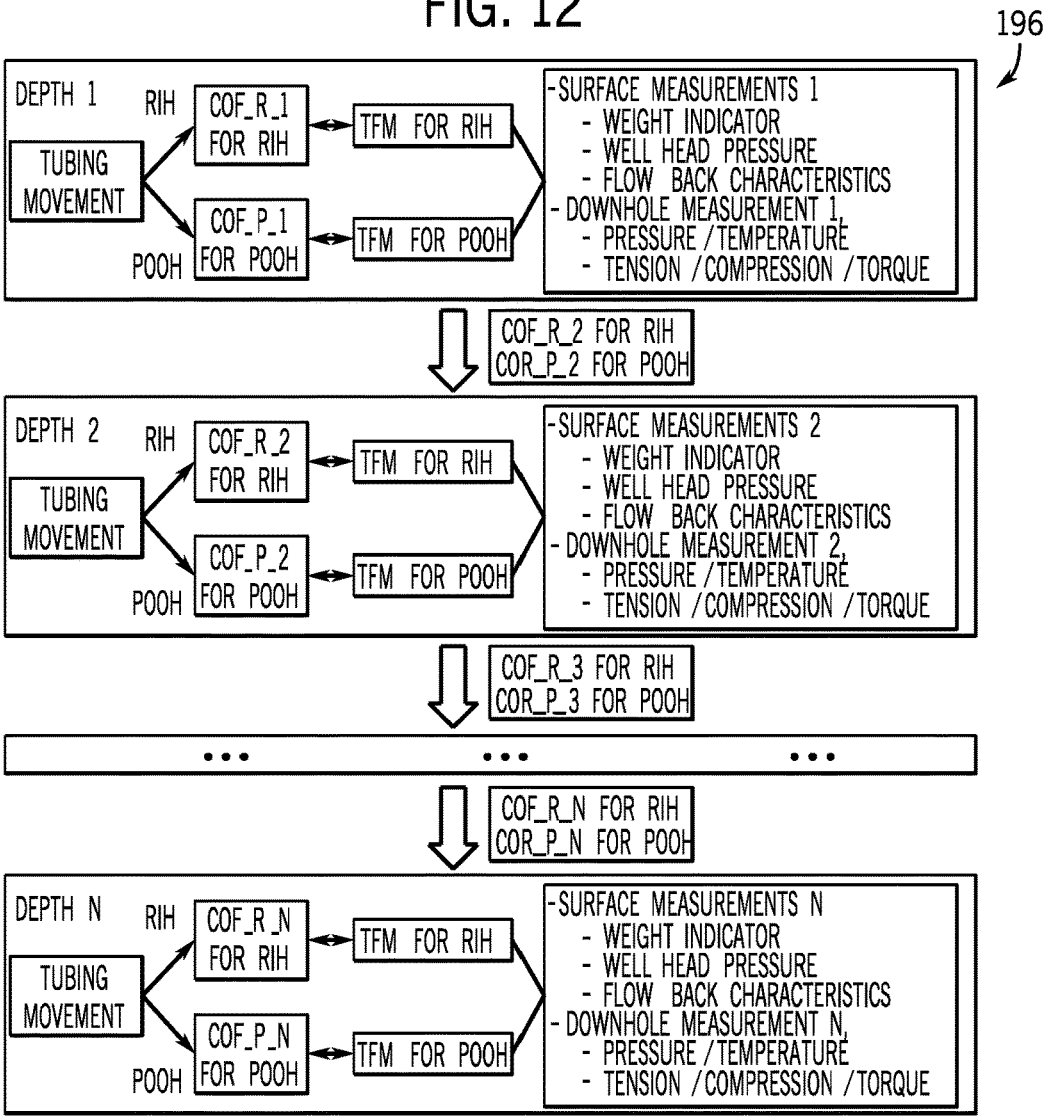
FIG. 13 is a graphical illustration of an example of data used in a model for determining coefficient of friction and corresponding coiled tubing string movement, in accordance with embodiments of the present disclosure.

Referring generally to FIG. 13, an example workflow 196 at each depth for achieving a desired ROP/tubing movement is provided. In the illustrated example, surface measurements and downhole measurements may be provided to a tubing force module (TFM) or other suitable software of the surface processing system 50 to determine the corresponding COF at that particular depth or position along the wellbore 14. As illustrated, calculation of the COF values may differ depending on whether the downhole well tool 42 is being run in hole (RIH) or pulled out of hole (POOH). As described in greater detail herein, in certain embodiments, for each update of the COF values, the TFM module may be updated.

The COF may then be used by the surface processing system 50 to determine the appropriate WOB to achieve the desired tubing movement/ROP for efficient milling of plugs 30 (or other downhole operation). In certain embodiments, the various measurements may be provided in real time to ensure rapid and accurate modeling of the data by the surface processing system 50 as the downhole well tool 42 is moved to different positions along the wellbore 14. In certain embodiments, well site measurements from both the surface and downhole may be utilized by the surface processing system 50 to continuously update model parameters and, thus, to enable a more accurate and consistent modeling with respect to predicting the appropriate WOB/tubing weight and, thus, the maximum or otherwise optimized ROP.

As illustrated in FIG. 13, in certain embodiments, examples of surface measurements obtained via surface sensors 54 include weight indications (e.g., tubing string weight indications, wellhead pressure, and flow back characteristics), and examples of downhole measurements obtained via the downhole sensor package 46 and downhole sensors 48 include pressure measurements, temperature measurements, tension and compression measurements (e.g., tension and compression in the coiled tubing 20), and torque acting on the downhole well tool 42, as described in greater detail herein.

Figure 14:
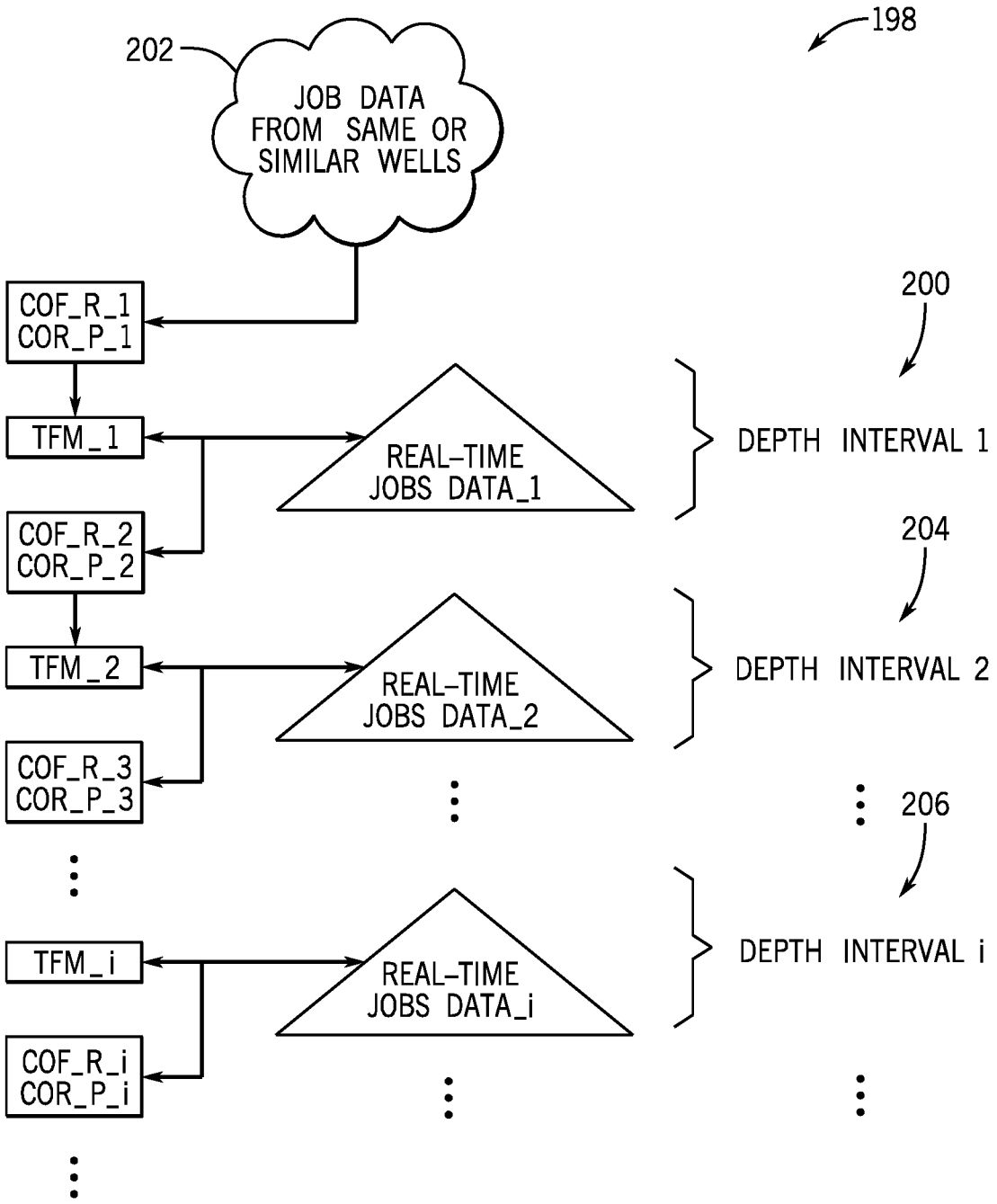
FIG. 14 is a graphical illustration showing real-time updating of coefficient of friction values to obtain the updated coefficient of friction values for use in determining an appropriate tubing weight for a desired rate of penetration, in accordance with embodiments of the present disclosure.

Referring generally to FIG. 14, a more detailed example of a workflow 198 for the real time updating of the COF values is illustrated. For the first depth interval 200 and the initial TFM model in this example, the COF value may be obtained from memory 202 (e.g., from the cloud storage 58 illustrated in FIG. 4) based on job data previously recorded from a similar well (or even the same well). For the second depth interval 204, the COF value may be updated on the edge (e.g., using an edge server, as described herein) based at least in part on real-time data obtained at least in part from downhole sensor package 46 and the downhole sensors 48.

Subsequently, for the third depth interval 206, the COF value may again be updated on the edge (e.g., using an edge server, as described herein) based at least in part on real-time data obtained at least in part from downhole sensor package 46 and the downhole sensors 48. Such updating may be continued during the job at each depth/borehole position. The interval between positions may be set by the surface processing system 50 at a desired value (e.g., every 500 feet, every 50 feet, every 5 feet, and so forth) depending on the parameters of a given operation and on various other factors such as computational resources. As described in greater detail herein, the surface processing system 50 may be in the form of a single component or multiple components located at the surface, downhole, and/or remote locations.

Figure 15:
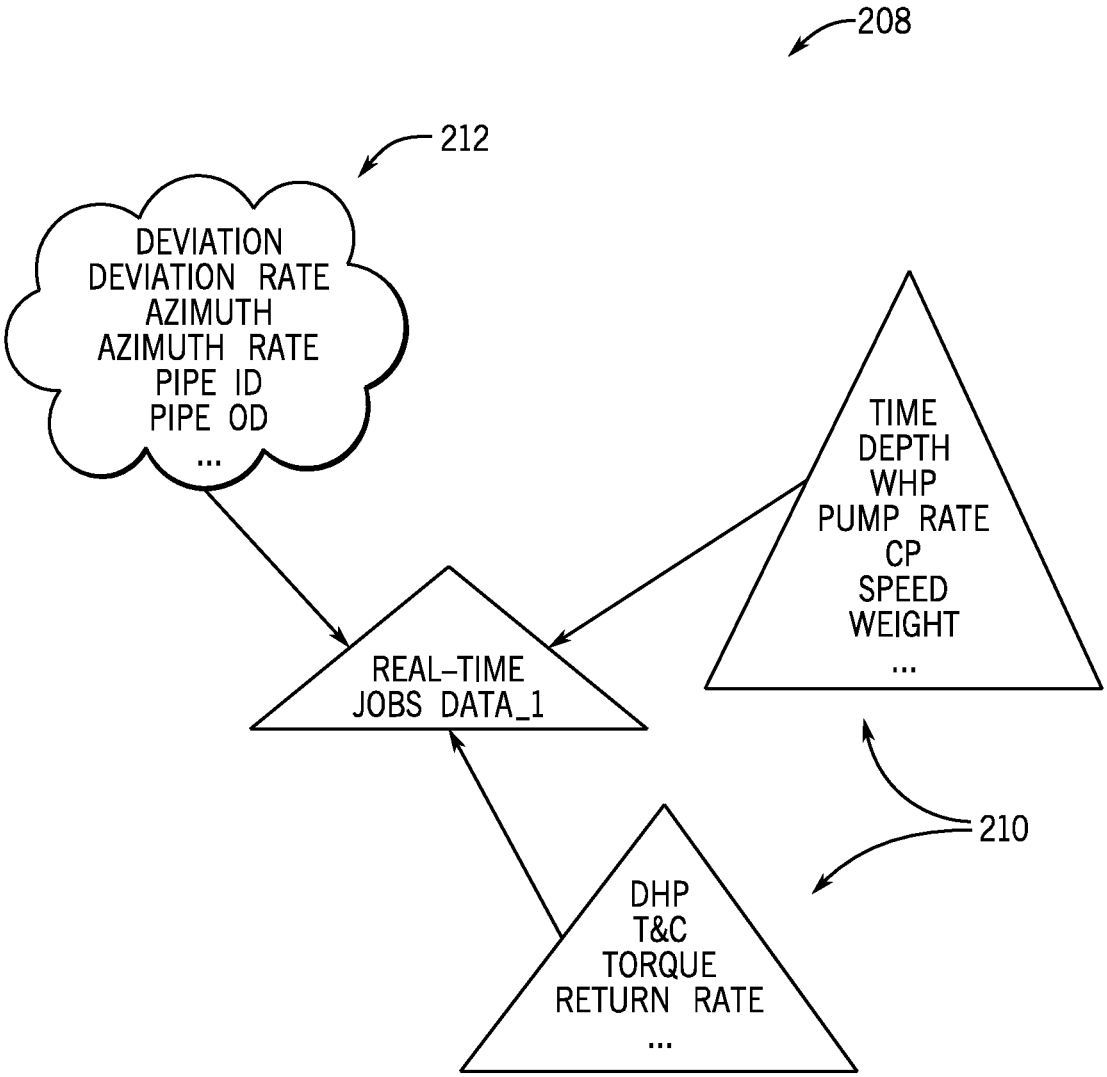
FIG. 15 is a graphical illustration showing real-time updating of coefficient of friction values based on data obtained on the edge during performance of an actual job and based on data previously accumulated or determined, in accordance with embodiments of the present disclosure.

Depending on the operation, the real time job data set may include different data sources and measurements (e.g., both on the edge and in the cloud, for example), as illustrated in the diagram 208 in FIG. 15. Examples of data 210 from real-time data sources may include a variety of edge parameters, such as time, depth, wellhead pressure, pump rate, circulation pressure, speed, weight, downhole pressure, tension and compression measurements, torque measurements, surface return rates, and/or other edge parameter measurements. Examples of data 212 obtained from the cloud (e.g., the cloud storage 58 illustrated in FIG. 4) may include, but is not limited to, wellbore deviation angle, deviation build rate, azimuth angle, azimuth build rate, pipe/tubing inside diameter, pipe/tubing outside diameter, and/or other data obtained from memory. This data may be processed in real time via the surface processing system 50 to continually/periodically update the COF to enable application of appropriate weight of the coiled tubing 20 to achieve an optimized ROP for a given operation.

As described in greater detail herein, embodiments of the present disclosure include a method that includes deploying a downhole well tool into a wellbore of a well via coiled tubing; detecting one or more surface parameters via one or more surface sensors associated with surface equipment located at a surface of the well; and processing, via a surface processing system, the one or more surface parameters during operation of the downhole well tool to enable automatic adjustment of one or more operational parameters of the surface equipment based at least in part on the one or more surface parameters. In certain embodiments, the downhole well tool includes a milling tool. In addition, in certain embodiments, the method also includes using the milling tool to mill a plurality of plugs positioned along the wellbore.

In addition, in certain embodiments, the one or more surface parameters include a pumped flow rate of a fluid pumped into the wellbore through a pump unit located at the surface of the well, a rheology of the fluid pumped into the wellbore through the pump unit, a return flow rate of a return flow through flowback equipment located at the surface of the well, a rheology of the return flow through the flowback equipment, a pumped pressure of the fluid pumped into the wellbore through the pump unit, a return pressure of the return flow through the flowback equipment, or some combination thereof. In addition, in certain embodiments, the one or more operational parameters that are automatically adjusted by the surface processing system include a choke setting of a choke of flowback equipment located at the surface of the well, a pump rate or a fluid concentration of a fluid pumped into the wellbore through a pump unit located at the surface of the well, a position, a torque, or a weight-on-bit (WOB) condition of the downhole well tool, or some combination thereof.

In addition, in certain embodiments, the method also includes detecting one or more downhole parameters via one or more downhole sensors associated with the downhole well tool; and processing, via the surface processing system, the one or more surface parameters and the one or more downhole parameters during operation of the downhole well tool to enable automatic adjustment of one or more operational parameters of the surface equipment and the downhole well tool based at least in part on the one or more surface parameters and the one or more downhole parameters. In addition, in certain embodiments, the one or more downhole parameters include a downhole flow rate of a fluid pumped through the downhole well tool, a rheology of the fluid pumped through the downhole well tool, a downhole pressure of the fluid pumped through the downhole well tool, a force imparted on the downhole well tool, a torque applied to the downhole well tool, or some combination thereof.

Embodiments of the present disclosure also include a surface processing system that includes one or more non-transitory computer-readable storage media storing instructions which, when executed, cause at least one processor to perform operations including receiving one or more surface parameters detected by one or more surface sensors associated with surface equipment located at a surface of a well; and processing the one or more surface parameters during operation of a downhole well tool deployed in a wellbore of the well via coiled tubing to enable automatic adjustment of one or more operational parameters of the surface equipment based at least in part on the one or more surface parameters. In certain embodiments, the downhole well tool includes a milling tool configured to mill a plurality of plugs positioned along the wellbore.

In addition, in certain embodiments, the one or more surface parameters include a pumped flow rate of a fluid pumped into the wellbore through a pump unit located at the surface of the well, a rheology of the fluid pumped into the wellbore through the pump unit, a return flow rate of a return flow through flowback equipment located at the surface of the well, a rheology of the return flow through the flowback equipment, a pumped pressure of the fluid pumped into the wellbore through the pump unit, a return pressure of the return flow through the flowback equipment, or some combination thereof. In addition, in certain embodiments, the one or more operational parameters that are automatically adjusted include a choke setting of a choke of flowback equipment located at the surface of the well, a pump rate or a fluid concentration of a fluid pumped into the wellbore through a pump unit located at the surface of the well, a position, a torque, or a weight-on-bit (WOB) condition of the downhole well tool, or some combination thereof.

In addition, in certain embodiments, the operations also include receiving one or more downhole parameters detected by one or more downhole sensors associated with the downhole well tool; and processing the one or more surface parameters and the one or more downhole parameters during operation of the downhole well tool to enable automatic adjustment of one or more operational parameters of the surface equipment and the downhole well tool based at least in part on the one or more surface parameters and the one or more downhole parameters. In addition, in certain embodiments, the one or more downhole parameters include a downhole flow rate of a fluid pumped through the downhole well tool, a rheology of the fluid pumped through the downhole well tool, a downhole pressure of the fluid pumped through the downhole well tool, a force imparted on the downhole well tool, a torque applied to the downhole well tool, or some combination thereof.

Embodiments of the present disclosure also include a method that includes deploying a downhole well tool into a wellbore of a well via coiled tubing; collecting downhole measurements via one or more downhole sensors associated with the downhole well tool; and processing, via a surface processing system, the downhole measurements during operation of the downhole well tool to identify a signal of interest from the collected downhole measurements, and to indicate a new formation zone based at least in part on the identified signal of interest. In certain embodiments, the downhole well tool includes a milling tool. In addition, in certain embodiments, the method also includes using the milling tool to mill a plurality of plugs positioned along the wellbore. In addition, in certain embodiments, the method also includes using the downhole measurements to adjust a weight on bit (WOB) on one or more of the plugs.

In addition, in certain embodiments, the method also includes adjusting a pump rate of a fluid pumped into the wellbore through a pump unit located at a surface of the well in response to an indication that the new formation zone is indicated is a thief zone. In addition, in certain embodiments, the method also includes increasing a choke aperture of a choke of flowback equipment located at a surface of the well in response to an indication that the new formation zone has a higher pressure than a previously encountered formation zone. In addition, in certain embodiments, the method also includes reducing a choke aperture of a choke of flowback equipment located at a surface of the well in response to an indication that the new formation zone has a lower pressure than a previously encountered formation zone. In addition, in certain embodiments, the method also includes maintaining a choke aperture of a choke of flowback equipment located at a surface of the well in response to an indication that the new formation zone has a pressure substantially similar to that of a previously-encountered formation zone. In addition, in certain embodiments, the method also includes using the downhole measurements to characterize a surrounding reservoir. In addition, in certain embodiments, the method also includes using the downhole measurements to adjust a flow back schedule to increase production from a surrounding reservoir. In addition, in certain embodiments, the method also includes using the downhole measurements to predict a remaining life of the downhole well tool.

Embodiments of the present disclosure also include a method that includes moving a downhole well tool along a wellbore via coiled tubing; determining a desired rate of penetration (ROP) of the downhole well tool; determining a coefficient of friction (COF) acting on the coiled tubing; adjusting a weight of the coiled tubing to achieve the desired ROP based at least in part on the COF acting on the coiled tubing; and updating the COF when the downhole well tool is moved to different positions along the wellbore to enable corresponding changes to the weight of the coiled tubing to maintain the desired ROP. In addition, in certain embodiments, the downhole well tool includes a milling tool. In addition, in certain embodiments, the method includes using the milling tool to mill out plugs disposed along the wellbore. In addition, in certain embodiments, determining the desired ROP includes determining a maximum ROP.

In addition, in certain embodiments, the method includes adjusting the weight of the coiled tubing includes using a tubing force module that uses the COF to determine the weight of the coiled tubing at a surface of the well as a function of a depth of the coiled tubing for achieving the desired ROP. In addition, in certain embodiments, updating the COF includes updating the COF at least once every 500 feet of movement of the downhole well tool along the wellbore. In addition, in certain embodiments, updating the COF includes updating the COF at least once every 50 feet of movement of the downhole well tool along the wellbore. In addition, in certain embodiments, updating the COF includes updating the COF at least once every 5 feet of movement of the downhole well tool along the wellbore.

In addition, in certain embodiments, moving the downhole well tool along the wellbore includes running the downhole well tool into the wellbore. In addition, in certain embodiments, moving the downhole well tool along the wellbore includes pulling the downhole well tool out of the wellbore.

Embodiments of the present disclosure also include a method that includes positioning a downhole well tool on coiled tubing to form a coiled tubing string; obtaining sensor data as the downhole well tool is moved along a wellbore by the coiled tubing; using the sensor data to determine a coefficient of friction (COF) value based on friction acting on the coiled tubing string; updating the COF value based on the sensor data to obtain updated COF values when the downhole well tool is moved to different positions in the wellbore; and employing the updated COF values to adjust a tubing weight acting on the downhole well tool to achieve a desired rate of penetration (ROP). In certain embodiments, adjusting the tubing weight of the coiled tubing acting on the downhole well tool includes using a tubing force module that uses the COF to determine the weight of the coiled tubing at a surface of the well as a function of a depth of the coiled tubing for achieving the desired ROP. In addition, in certain embodiments, the method also includes obtaining an initial COF value based on data acquired from another well. In addition, in certain embodiments, the method also includes positioning the downhole well tool includes positioning a milling tool, wherein the milling tool is used to mill out plugs located along the wellbore. In addition, in certain embodiments, obtaining the sensor data includes obtaining downhole data and surface data. In addition, in certain embodiments, obtaining the sensor data includes obtaining sensor data as the downhole well tool is run into the wellbore. In addition, in certain embodiments, obtaining the sensor data includes obtaining sensor data as the downhole well tool is pulled out of the wellbore.

Embodiments of the present disclosure also include a system that includes a coiled tubing string having a milling tool deployed downhole in a wellbore via coiled tubing; a sensor system having one or more surface sensors and one or more downhole sensors, the one or more downhole sensors being mounted on the coiled tubing string; and a processing system that receives data from the sensor system in substantially real time at a plurality of locations along the wellbore, determines a coefficient of friction (COF) value acting on the coiled tubing string at each of the plurality of locations along the wellbore based at least in part on the sensor data, and optimizes a rate of penetration (ROP) during a milling operation based at least in part on the COF values determined at the plurality of locations along the wellbore. In certain embodiments, the milling tool is operated to mill out a plurality of plugs deployed along the wellbore. In addition, in certain embodiments, the processing system uses data from the sensor system to periodically update a coefficient of friction (COF) value that is based on friction between the coiled tubing string and a surrounding wellbore wall.

Embodiments of the present disclosure also include a method that includes deploying a well tool downhole into a borehole via coiled tubing; obtaining downhole parameters in real time while the well tool is downhole; combining the downhole parameters with surface parameters; and processing the downhole parameters and the surface parameters during use of the well tool downhole to enable automatic optimization with respect to use of the well tool during subsequent stages of well tool use downhole. In certain embodiments, deploying the well tool includes deploying a milling tool. In addition, in certain embodiments, the method also includes using the milling tool to mill a plurality of plugs positioned along the borehole. In addition, in certain embodiments, obtaining downhole parameters includes obtaining downhole weight on bit (WOB). In addition, in certain embodiments, obtaining downhole parameters includes obtaining torque acting on the well tool. In addition, in certain embodiments, obtaining downhole parameters includes obtaining pressures.

In addition, in certain embodiments, the method also includes combining downhole parameters with surface parameters including a pump rate of fluid pumped downhole to operate the well tool. In addition, in certain embodiments, the method also includes combining downhole parameters with surface parameters including a circulating pressure of fluid pumped downhole. In addition, in certain embodiments, the method also includes combining downhole parameters with surface parameters including a return flow rate of fluid pumped downhole to power the well tool. In addition, in certain embodiments, the method also includes combining downhole parameters with surface parameters including choke settings for chokes governing a return fluid flow. In addition, in certain embodiments, the method also includes combining downhole parameters with surface parameters including historical data from well operations in other wells.

Embodiments of the present disclosure also include a method that includes deploying a well tool downhole into a wellbore via coiled tubing; operating the well tool along the wellbore; obtaining downhole measurements and surface measurements; and using a processor system to process data from the downhole measurements and the surface measurements to provide information for optimizing a downhole process or surface process regarding operation of the well tool. In certain embodiments, operating the well tool includes operating a milling tool for sequentially milling through plugs disposed along the wellbore. In addition, in certain embodiments, the method also includes processing data to adjust a WOB for each plug. In addition, in certain embodiments, the method also includes processing data to adjust a torque output of the milling tool. In addition, in certain embodiments, the method also includes processing data to characterize a reservoir. In addition, in certain embodiments, the method also includes processing data to optimize a flow back schedule to thus maximize production from a surrounding reservoir. In addition, in certain embodiments, the method also includes processing data to predict a life of the well tool.

Embodiments of the present disclosure also includes a system that includes a coiled tubing string having a milling tool deployed downhole in a borehole via coiled tubing; a sensor system having downhole sensors mounted on the coiled tubing string and surface sensors; and a processor-based system which receives data from the sensor system in real time, the processor system being configured to automatically optimize operation of the milling tool during sequential milling of plugs disposed along the borehole. In certain embodiments, the processor-based system uses data from the sensor system to periodically update a coefficient of friction value which is based on friction between the coiled tubing string and a surrounding borehole wall.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method, comprising:

deploying a downhole well tool comprising a milling tool into a wellbore of a well via coiled tubing utilizing a coiled tubing unit, wherein the coiled tubing unit comprises an injector head for controlling a weight of the coiled tubing while deploying the milling tool;

using the milling tool to mill a plurality of plugs positioned along the wellbore;

detecting one or more surface parameters via one or more surface sensors associated with surface equipment located at a surface of the well;

processing, via a surface processing system, the one or more detected surface parameters during operation of the downhole well tool, wherein processing the one or more detected surface parameters comprises analyzing the one or more detected surface parameters with respect to data relating to previous milling operations; and automatically adjusting one or more operational parameters of the surface equipment based at least in part on the one or more detected surface parameters, wherein the one or more operational parameters comprise the weight of the coiled tubing.

2. The method of claim 1, wherein detecting one or more surface parameters comprises detecting at least one surface parameter from the coiled tubing unit.

3. The method of claim 1, wherein the one or more surface parameters comprise a pumped flow rate of a fluid pumped into the wellbore through a pump unit located at the surface of the well, a rheology of the fluid pumped into the wellbore through the pump unit, a return flow rate of a return flow through flowback equipment located at the surface of the well, a rheology of the return flow through the flowback equipment, a pumped pressure of the fluid pumped into the wellbore through the pump unit, a return pressure of the return flow through the flowback equipment, or some combination thereof.

4. The method of claim 1, wherein the one or more operational parameters that are automatically adjusted by the surface processing system comprise a choke setting of a choke of flowback equipment located at the surface of the well, a pump rate or a fluid concentration of a fluid pumped into the wellbore through a pump unit located at the surface of the well, a position, a torque, or a weight-on-bit (WOB) condition of the downhole well tool, or some combination thereof.

5. The method of claim 1, comprising:

detecting one or more downhole parameters via one or more downhole sensors associated with the downhole well tool;

transmitting the downhole parameters detected by the downhole sensors in real-time along a telemetric control line extending from the downhole tool to the surface processing system;

processing, via the surface processing system, the one or more surface parameters and the one or more downhole parameters during operation of the downhole well tool; and automatically adjusting the one or more operational parameters of the surface equipment and the downhole well tool based at least in part on the one or more surface parameters and the one or more downhole parameters.

6. The method of claim 5, wherein the one or more downhole parameters comprise a downhole flow rate of a fluid pumped through the downhole well tool, a rheology of the fluid pumped through the downhole well tool, a downhole pressure of the fluid pumped through the downhole well tool, a force imparted on the downhole well tool, a torque applied to the downhole well tool, or some combination thereof.

7. The method of claim 1, comprising using the one or more detected surface parameters to predict a remaining life of the downhole well tool.

8. A surface processing system, comprising:

one or more non-transitory computer-readable storage media storing instructions which, when executed, cause at least one processor to perform operations comprising:

receiving one or more surface parameters detected by one or more surface sensors associated with surface equipment located at a surface of a well; and processing the one or more surface parameters during operation of a downhole well tool deployed in a wellbore of the well via coiled tubing to enable automatic adjustment of one or more operational parameters of the surface equipment based at least in part on the one or more surface parameters, wherein processing the one or more surface parameters comprises analyzing the one or more surface parameters with respect to data relating to previous milling operations, wherein the downhole well tool comprises a milling tool configured to mill a plurality of plugs positioned along the wellbore, and wherein the downhole well tool is deployed in the wellbore utilizing a coiled tubing unit, wherein the coiled tubing unit comprises an injector head for automatically controlling and adjusting a weight of the coiled tubing while deploying the milling tool, and wherein the coiled tubing weight comprises one of the received and processed surface parameters that enables the automatic adjustment of the coiled tubing unit.

9. The surface processing system of claim 8, wherein the one or more surface parameters comprise a pumped flow rate of a fluid pumped into the wellbore through a pump unit located at the surface of the well, a rheology of the fluid pumped into the wellbore through the pump unit, a return flow rate of a return flow through flowback equipment located at the surface of the well, a rheology of the return flow through the flowback equipment, a pumped pressure of the fluid pumped into the wellbore through the pump unit, a return pressure of the return flow through the flowback equipment, or some combination thereof.

10. The surface processing system of claim 8, wherein the one or more operational parameters that are automatically adjusted comprise a choke setting of a choke of flowback equipment located at the surface of the well, a pump rate or a fluid concentration of a fluid pumped into the wellbore through a pump unit located at the surface of the well, a position, a torque, or a weight-on-bit (WOB) condition of the downhole well tool, or some combination thereof.

11. The surface processing system of claim 8, wherein the operations comprise:

receiving one or more downhole parameters detected by one or more downhole sensors associated with the downhole well tool;

transmitting the downhole parameters detected by the downhole sensors in real-time along a telemetric control line extending from the downhole tool to the surface processing system; and processing the one or more surface parameters and the one or more downhole parameters during operation of the downhole well tool to enable automatic adjustment of one or more operational parameters of the surface equipment and the downhole well tool based at least in part on the one or more surface parameters and the one or more downhole parameters.

12. The surface processing system of claim 11, wherein the one or more downhole parameters comprise a downhole flow rate of a fluid pumped through the downhole well tool, a rheology of the fluid pumped through the downhole well tool, a downhole pressure of the fluid pumped through the downhole well tool, a force imparted on the downhole well tool, a torque applied to the downhole well tool, or some combination thereof.

13. The surface processing system of claim 8, wherein the operations comprise using the one or more surface parameters to predict a remaining life of the downhole well tool.

* * * * *